US009551190B2

(12) United States Patent
Hiwasa et al.

(10) Patent No.: US 9,551,190 B2
(45) Date of Patent: Jan. 24, 2017

(54) EXCAVATION TOOL

(71) Applicant: MITSUBISHI MATERIALS CORPORATION, Tokyo (JP)

(72) Inventors: Yoneo Hiwasa, Anpachi-gun (JP); Masaya Hisada, Anpachi-gun (JP); Kazuyoshi Nakamura, Anpachi-gun (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 322 days.

(21) Appl. No.: 14/356,443

(22) PCT Filed: Nov. 30, 2012

(86) PCT No.: PCT/JP2012/081049

§ 371 (c)(1),
(2) Date: May 6, 2014

(87) PCT Pub. No.: WO2013/081098

PCT Pub. Date: Jun. 6, 2013

(65) Prior Publication Data

US 2014/0311808 A1 Oct. 23, 2014

(30) Foreign Application Priority Data

Nov. 30, 2011 (JP) ..... 2011-262526
Nov. 15, 2012 (JP) ..... 2012-251357

(51) Int. Cl.
*E21B 10/43* (2006.01)
*E21B 10/56* (2006.01)
(Continued)

(52) U.S. Cl.
CPC ..... *E21B 10/43* (2013.01); *E21B 10/633* (2013.01)

(58) Field of Classification Search
CPC .... E21B 2010/425; E21B 10/43; E21B 10/46; E21B 10/52; E21B 10/56; E21B 2010/564; E21B 2010/562; E21B 10/5673; E21B 10/62; E21B 2010/622; E21B 2010/624; E21B 10/27; E21B 10/633
See application file for complete search history.

(56) References Cited

U.S. PATENT DOCUMENTS 3,618,683 A 11/1971 Hughes
3,749,190 A 7/1973 Shipman
(Continued)

FOREIGN PATENT DOCUMENTS

CN 101248251 A 8/2008
CN 101321925 A 12/2008
(Continued)

OTHER PUBLICATIONS

Decision of Grant mailed Jul. 1, 2015, issued for the Russian patent application No. 201 41 21 927 and English translation thereof.
(Continued)

*Primary Examiner* — Cathleen Hutchins
(74) *Attorney, Agent, or Firm* — Locke Lord LLP; James E. Armstrong, IV; Howard M. Gitten

(57) ABSTRACT

In an excavation tool of the present invention, an embedding hole is drilled in a distal end portion of a tool body which is rotated about an axis line O and is moved forward to a distal end side in a direction of the axis line O. In the embedding hole, an excavation tip in which an embedding portion having an outer cylindrical shape is formed integrally with a cutting edge portion inserts the embedding portion into the embedding hole and causes the cutting edge portion to protrude from the embedding hole. In this manner, the excavation tip is rotatable around a central axis C of the embedding portion during excavation, and is attached
(Continued)

thereto by being locked so as not to slip toward a distal end side of the embedding portion 6 in a direction of the central axis C.

12 Claims, 17 Drawing Sheets

(51) Int. Cl.

| | |
|---|---|
| ***E21B 10/573*** | (2006.01) |
| ***E21B 10/62*** | (2006.01) |
| ***E21B 10/633*** | (2006.01) |

(56) References Cited

U.S. PATENT DOCUMENTS

| | | | | |
|---|---|---|---|---|
| 4,216,832 | A | 8/1980 | Stephenson et al. | |
| 4,538,690 | A | 9/1985 | Short, Jr. | |
| 4,668,118 | A | 5/1987 | Bucher et al. | |
| 4,725,099 | A | 2/1988 | Penkunas et al. | |
| 4,821,819 | A | 4/1989 | Whysong | |
| 5,423,719 | A | 6/1995 | Jennings | |
| 5,678,645 | A * | 10/1997 | Tibbitts | E21B 10/5673 175/426 |
| 5,873,423 | A | 2/1999 | Briese | |
| 5,906,245 | A | 5/1999 | Tibbitts et al. | |
| 6,113,195 | A | 9/2000 | Mercier et al. | |
| 6,375,272 | B1 | 4/2002 | Ojanen | |
| 6,758,530 | B2 | 7/2004 | Sollami | |
| 8,011,456 | B2 | 9/2011 | Sherwood, Jr. | |
| 2002/0066600 | A1 | 6/2002 | Dvorachek | |
| 2003/0051924 | A1 | 3/2003 | Tsuda et al. | |
| 2003/0052530 | A1 | 3/2003 | Sollami | |
| 2003/0141753 | A1 | 7/2003 | Peay et al. | |
| 2007/0199739 | A1 | 8/2007 | Schwefe et al. | |
| 2012/0273281 | A1* | 11/2012 | Burhan | E21B 10/54 175/431 |

FOREIGN PATENT DOCUMENTS

| | | | |
|---|---|---|---|
| GB | 1602697 | A | 11/1981 |
| JP | 09-242456 | A | 9/1997 |
| JP | 11-229777 | A | 8/1999 |
| JP | 2002-250193 | A | 9/2002 |
| JP | 2002-349173 | A | 12/2002 |
| JP | 2005-273439 | A | 10/2005 |
| JP | 2007-162220 | A | 6/2007 |
| JP | 2007-277946 | A | 10/2007 |
| JP | 2008-144561 | A | 6/2008 |
| JP | 2010-180551 | A | 8/2010 |
| JP | 2011-042991 | A | 3/2011 |
| JP | 2013-079519 | A | 5/2013 |
| RU | 2382867 | C2 | 2/2010 |
| RU | 23 87787 | C1 | 4/2010 |
| RU | 2451151 | C1 | 5/2012 |
| SU | 88114 | A | 2/1950 |

OTHER PUBLICATIONS

Office Action dated Oct. 16, 2015, issued for the Australian patent application No. 2012343451.

Supplementary European Search Report dated Oct. 30, 2015, issued for the European patent application No. 12853335.3.

Decision of Rejection mailed Feb. 16, 2016, issued for the Korean patent application No. 10-2014-7013893 and English translation thereof.

Office Action mailed Feb. 23, 2016, issued for the Chinese patent application No. 201280058380.3 and English translation thereof.

Office Action dated May 26, 2015, issued for the Chinese patent application No. 201280058380.3 and English translation thereof.

Office Action mailed Mar. 27, 2015, issued for the Russian patent application No. 2014121927 and English translation thereof.

International Search Report dated Mar. 5, 2013, issued for PCT/JP2012/081049.

* cited by examiner

EXCAVATION TOOL

TECHNICAL FIELD

The present invention relates to an excavation tool in which an embedding hole is drilled in a distal end portion of a tool body which is rotated about an axis line and is moved forward to a distal end side in a direction of the axis line, and in which an excavation tip made of a hard material is embedded in the embedding hole so that a cutting edge portion of the distal end thereof protrudes therefrom.

Priority is claimed on Japanese Patent Application No. 2011-262526, filed Nov. 30, 2011 and Japanese Patent Application No. 2012-251357, filed Nov. 15, 2012, the contents of which are incorporated herein by reference.

BACKGROUND ART

For example, as disclosed in PTLs 1 and 2, a known excavation tool includes those which form an excavation pit in the ground or in rock in the following manner. A steel tool body, to a distal end of which multiple excavation tips made of sintered alloys such as ultra-hard metal alloys are attached, is attached to a distal end portion of an excavation rod or is attached via a device to the distal end portion of the excavation rod. The excavation tool uses a rotating force about an axis line of the tool body, which is transmitted from an excavator via the excavation rod, a thrust force toward the distal end side in a direction of the axis line, and a striking force toward the distal end side in the direction of the axis line, which is transmitted from a down-the-hole hammer via the device in addition to the rotating force and the thrust force.

Incidentally, the excavation tool in the related art has a configuration as follows. In an embedding hole drilled in the distal end portion of the tool body, an excavation tip made of the sintered alloys is configured so that a cylindrical embedding portion is formed integrally with a spherical, conical or bullet-shaped cutting edge portion disposed in a distal end side of the embedding portion. The excavation tip protrudes the cutting edge portion from the embedding hole. The embedding portion is firmly fixed in the embedding hole by interference fit such as shrink fitting. In this manner, the embedding portion is embedded in and attached to the embedding hole.

Then, in this excavation tool used in excavating the ground or the rock, the cutting edge portion of the excavation tip which is protruded from the embedding hole in this way is used in excavating by being brought into contact with the ground or the rock and by being caused to penetrate the ground or the rock. Correspondingly, wear and abrasion of the cutting edge portion progressively occur. In the worn cutting edge portion, the radius of curvature increases on the curved surface thereof. Therefore, the sharpness of the cutting edge is impaired, thereby the excavation efficiency decreases. Furthermore, if the wear of the excavation tip progressively occurs until the diameter of the excavation pit becomes an acceptable diameter or smaller, the tool life of the excavation tool is finished.

However, the wear and the abrasion of the cutting edge portion of the excavation tip are not uniform. For example, among the multiple excavation tips embedded in the distal end portion of the tool body, especially in the excavation tip embedded in a gauge portion of an outer peripheral side of the distal end portion, the wear and the abrasion become significant on a surface facing the outer peripheral side. Since asymmetrical wear occurs, an excavation performance is likely to be impaired, thereby causing decreased excavation efficiency. This wear of the excavation tip in the gauge portion is relevant to a decrease in the diameter of the excavation pit, and thereby seriously affects tool life.

Then, this uneven wear of the cutting edge portion of the excavation tip is more significant under conditions where the cutting edge portion is seriously worn due to the hard ground or rock. As a result, the tool life is shortened and the cost for excavation increases. In addition, it also takes money and time to regrind the cutting edge portion of the excavation tip in order to recover the excavation performance. Furthermore, if the tool life of the excavation tool is finished before the excavation pit is excavated to reach a desired depth, it takes time, effort and money to replace the tool body. In addition, if the wear and the abrasion of the cutting edge portion progressively occur and yet the excavation is continued while the excavation performance remains impaired, the wear or damage may occur in the tool body, and an overload is imposed on the excavator.

CITATION LIST

Patent Literature

[PTL 1] Japanese Unexamined Patent Application, First Publication No. 2010-180551

[PTL 2] Japanese Unexamined Patent Application, First Publication No. 2011-042991

SUMMARY OF INVENTION

Problem to be Solved by the Invention

The present invention is made under the above-described circumstances, and an object thereof is to provide an excavation tool which can maintain excavation performance and excavation efficiency of an excavation tip over a longer period, can improve tool life and can reduce excavation cost per unit depth of an excavation pit.

Means for Solving the Problem

An aspect of an excavation tool of the present invention includes any one of the following configurations.

(1) An excavation tool includes a tool body centered on an axis line; and an excavation tip which is attached to an embedding hole bored drilled in a distal end portion of the tool body. The tool body is centered on the axis line and is moved forward to a distal end side in a direction of the axis line. The excavation tip is configured so that an embedding portion having an outer cylindrical shape about a central axis is formed integrally with a cutting edge portion of a distal end side in a direction of the central axis. The embedding portion is inserted into the embedding hole and the cutting edge portion is protruded from the embedding hole. At least one excavation tip serves as a rotary excavation tip which is rotatable about the central axis of the embedding portion during excavation, is locked so as not to slip toward the distal end side in the direction of the central axis and is attached to the embedding portion.

(2) In the above-described (1), a plurality of the excavation tips is attached to the tool body. Out of the excavation tips, some of the excavation tips serve as the rotary excavation tip and the remaining excavation tip is fixed and attached to the tool body.

(3) In the above-described (1) or (2), a plurality of the excavation tips are attached to the tool body. Out of the excavation tips, at least one excavation tip attached to an outer peripheral portion of a distal end surface of the tool body serves as the rotary excavation tip and the remaining excavation tip is fixed and attached to the tool body.

(4) In any one of the above-described (1) to (3), between an outer peripheral surface of the embedding portion of the rotary excavation tip and an inner peripheral surface of the embedding hole to which the rotary excavation tip is attached, a first surface has a concave groove going around the central axis and a second surface has a convex portion accommodated in the concave groove.

(5) In the above-described (4), one of the concave groove and the convex portion is formed by an intermediate member which is attached and fixed to either the outer peripheral surface of the embedding portion or the inner peripheral surface of the embedding hole on which one of the concave groove and the convex portion is disposed.

(6) In any one of the above-described (1) to (3), a concave groove going around the central axis is formed on an outer peripheral surface of the embedding portion of the rotary excavation tip. On an inner peripheral surface of the embedding hole to which the rotary excavation tip is attached, a concave portion going around the central axis or a pothole opening portion extending in a tangential direction of the concave groove is formed at a position opposing the concave groove in the direction of the central axis. A locking member is accommodated in both of the concave groove and the concave portion or the pothole opening portion.

(7) In any one of the above-described (1) to (6), the embedding portion of the rotary excavation tip is attached to the embedding hole by interference fit in which a interference of an outer diameter d (mm) of the embedding portion is 0.5×d/1000 (mm) to 1.5×d/1000 (mm).

(8) In any one of the above-described (1) to (7), a surface-hardened layer is formed on at least a surface of the rotary excavation tip.

(9) In any one of the above-described (1) to (8), a surface-hardened layer is formed in the vicinity of the embedding hole to which at least the rotary excavation tip of the tool body is attached.

(10) In any one of the above-described (1) to (9), a lubricant is interposed between the outer peripheral surface of the embedding portion of the rotary excavation tip and the inner peripheral surface of the embedding hole to which the rotary excavation tip is attached.

In the excavation tool configured as described above, the rotary excavation tip is rotatable about the central axis of the embedding portion having the outer cylindrical shape which is inserted into the embedding hole of the tool body during excavation. Accordingly, corresponding to the rotation of the tool body during the excavation, the rotary excavation tip is driven to rotate around the central axis by receiving contact resistance from the ground or the rock. Therefore, the cutting edge portion of the rotary excavation tip is also uniformly worn in a circumferential direction around the central axis. A shape of the cutting edge portion can be maintained without the cutting edge being partially and asymmetrically worn. Thus, it is possible to reduce significant degradation in excavation performance or excavation efficiency by preventing the radius of curvature of a curved surface configuring the cutting edge portion from increasing in size.

In contrast, the rotary excavation tip is locked so as not to slip toward the distal end side in the direction of the central axis. Accordingly, there is no possibility that the excavation tip may fall out inadvertently. For example, a state where the rotary excavation tip is locked so as not to slip may include a state where the rotary excavation tip does not fall out from the embedding hole due to the self-weight when the tool body is held by causing the distal end portion of the tool body to face downward.

Here, when a plurality of the excavation tips is attached to the tool body, all of the excavation tips may be the rotary excavation tips which are to be rotated around the central axis during the excavation in this manner. In addition, out of a plurality of the excavation tips, some of the excavation tips may serve as the rotary excavation tip and the remaining excavation tip may be fixed and attached to the tool body. It is possible to extend tool life, since the excavation performance or the excavation efficiency is maintained by the rotary excavation tip.

In particular, when a plurality of the excavation tips is attached to the tool body in this manner, if out of the excavation tips, at least one excavation tip attached to the outer peripheral portion of the distal end surface of the tool body serves as the rotary excavation tip, even though the remaining excavation tip is fixed and attached to the tool body, at least one rotary excavation tip in the outer peripheral portion of the distal end surface, that is, in the gauge portion, maintains the excavation performance or the excavation efficiency. This can effectively reduce a decrease in the diameter of the excavation pit and can reliably improve tool life.

In addition, when the rotary excavation tip is attached to the embedding hole so as to be rotatable around the central axis during the excavation and to be locked against the distal end side in the direction of the central axis, first of all, between the outer peripheral surface of the embedding portion of the excavation tip and the inner peripheral surface of the embedding hole to which the excavation tip is attached, it is preferable to dispose the concave groove going around the central axis in a first surface and to dispose the convex portion accommodated in the concave groove in a second surface.

Here, when the concave groove and the convex portion are directly formed on the outer peripheral surface of the embedding portion of the rotary excavation tip and the inner peripheral surface of the embedding hole of the tool body, by utilizing a difference in the Young's modulus between the rotary excavation tip and the tool body, it is preferable to increase the diameter of the embedding hole by elastically deforming the tool body and to press-fit the embedding portion of the rotary excavation tip. Alternatively, by utilizing a difference in thermal expansion coefficient between the rotary excavation tip and the tool body, the embedding portion of the rotary excavation tip may be inserted into the embedding hole after heating the tool body and causing the embedding hole to be thermally expanded.

In addition, without directly forming the concave groove and the convex portion on the outer peripheral surface of the embedding portion of the rotary excavation tip and the inner peripheral surface of the embedding hole of the tool body in this manner, one of the concave groove and the convex portion may be formed to have the intermediate member which is attached and fixed to the outer peripheral surface of the embedding portion or the inner peripheral surface of the embedding hole in which one of the concave groove and the convex portion is disposed. In this case, it is also preferable to fix the intermediate member to the outer peripheral surface of the embedding portion or the inner peripheral surface of the embedding hole in which one of the concave groove and the convex portion which is formed in the intermediate member is disposed, by press fitting, shrink fitting using a difference in the thermal expansion coefficient, or interference fit such as the cool fitting described above.

Second of all, without accommodating the convex portion in the concave groove in this manner, the concave groove going around the central axis is formed on the outer peripheral surface of the embedding portion of the rotary excavation tip. On the inner peripheral surface of the embedding hole to which the rotary excavation tip is attached, the concave portion going around the central axis or the pothole opening portion extending in the tangential direction of the concave groove is formed at the position opposing the concave groove in the direction of the central axis. In this manner, the locking member may be accommodated in both of the concave groove and the concave portion or the pothole opening portion.

Here, when the concave portion going around the central axis the same as that of the concave groove is formed on the inner peripheral surface of the embedding hole, it is preferable to decrease the diameter of a C-type ring serving as the locking member, to accommodate the C-type ring in the concave groove of the outer peripheral surface of the embedding portion for example, and to insert the C-type ring into the embedding hole. Then, after the position of the concave groove coincides with the position of the concave portion, it is preferable to increase the diameter of the C-type ring by using elastic deformation and to accommodate the C-type ring in both of the concave groove and the concave portion. Alternatively, multiple spherical members serving as the locking member may be inserted from the outside into an annular hole which is formed by the concave groove coinciding with the concave portion, and the C-type ring may be accommodated in both of the concave groove and the concave portion. In addition, when the pothole opening portion extending in the tangential direction of the concave groove is formed on the inner peripheral surface of the embedding hole, a pin serving as the locking member may be inserted into the pothole and the pin may be accommodated in both of the concave groove.

Furthermore, the embedding portion of the rotary excavation tip may be attached to the embedding hole by the interference fit in which the interference with respect to the outer diameter d (mm) of the embedding portion is in the range of $0.5 \cdot d/1000$ (mm) to $1.5 \cdot d/1000$ (mm). If the interference fit is performed in this range of the interference, the rotary excavation tip is not rotatable during non-excavation. However, the rotary excavation tip can be driven to be rotatable against the friction with the embedding hole by using the contact resistance occurring from the ground or the rock which is caused by the rotation of the tool body during the excavation. In addition, it is possible to lock the rotary excavation tip so as not to fall out of the embedding hole.

The surface hardened layer may be formed on at least the surface of the rotary excavation tip. For example, coating treatment such as DLC, PVD, CVD and the like is performed on the surface of the embedding portion of the rotary excavation tip so as to form the surface hardened layer. In this manner, it is possible to improve strength of the embedding portion and to improve rotating and sliding performance of the embedding portion inside the embedding hole. In addition, the surface hardened layer is formed on the surface of the cutting edge potion of the rotary excavation tip by using the above-described coating treatment or the surface hardened layer formed of a polycrystalline diamond is formed on the surface of the cutting edge portion. In this manner, it is possible to further extend the tool life by improving the wear resistance of the cutting edge portion. The above-described surface hardened layer may be formed on the surface of the excavation tip which is fixed to the tool body.

In addition, the above-described surface hardened layer may be formed in the vicinity of the embedding hole to which at least the rotary excavation tip of the tool body is attached. In this manner, it is possible to prevent the wear of the embedding hole caused by the rotation of the rotary excavation tip during the excavation. In particular, it is advantageous when the concave groove or the convex portion is directly formed on the inner peripheral surface of the embedding hole of the tool body. The surface hardened layer in the vicinity of the embedding hole as described above may be formed by high-frequency hardening, carburizing, laser hardening, nitriding treatment or the like, for example, in addition to the above-described coating treatment such as DLC, PVD, CVD and the like.

Furthermore, a lubricant may be interposed between the outer peripheral surface of the embedding portion of the rotary excavation tip and the inner peripheral surface of the embedding hole to which the rotary excavation tip is attached. The interposed lubricant enables the rotary excavation tip to be smoothly rotated. Thus, it is possible to further reduce the wear of the embedding portion and the embedding hole.

Furthermore, the buffer material may be interposed between the rear end surface of the embedding portion of the rotary excavation tip and the hole bottom surface of the embedding hole to which the rotary excavation tip is attached. For example, the buffer material having lower rigidity than that of the rotary excavation tip or the tool body, such as a copper plate, is interposed therebetween. In this manner, it is possible to prevent damage to the tool body by preventing a load generated during the excavation from being directly applied to the tool body from the rotary excavation tip.

In addition, the rear end surface of the embedding portion of the rotary excavation tip may include a convex and conical surface-shaped potion centered around the central axis, and the hole bottom surface of the embedding hole to which the rotary excavation tip is attached may include a concave and conical surface-shaped portion which opposes the convex and conical surface-shaped potion. The concave and conical surface-shaped portion and convex and conical surface-shaped potion are brought into sliding contact with each other or are caused to oppose each other via the buffer material. In this manner, the rotary excavation tip can be reliably rotated around the central axis during the excavation. The concave and conical surface-shaped portion and convex and conical surface-shaped potion, or the buffer material as described above may be included in the embedding portion or in the embedding hole which is fixed to the tool body.

Effects of the Invention

As described above, according to the present invention, in the excavation tip which is attached so as to be rotatable around the central axis of the embedding portion during the excavation, and is locked so as not to slip toward the distal end side in the direction of the central axis, it is possible to achieve uniform wear of the cutting edge portion without causing the excavation tip to fall therefrom. Even under conditions where the cutting edge portion is seriously worn due to the hard ground or rock, it is not necessary to regrind the cutting edge portion by preventing the uneven wear such as the asymmetrical wear. Therefore, it is possible to improve tool life and reduce the excavation cost per unit depth of the excavation pit by maintaining the excavation performance and excavation efficiency of an excavation tip over a longer period.

DESCRIPTION OF EMBODIMENTS

Figure 1:
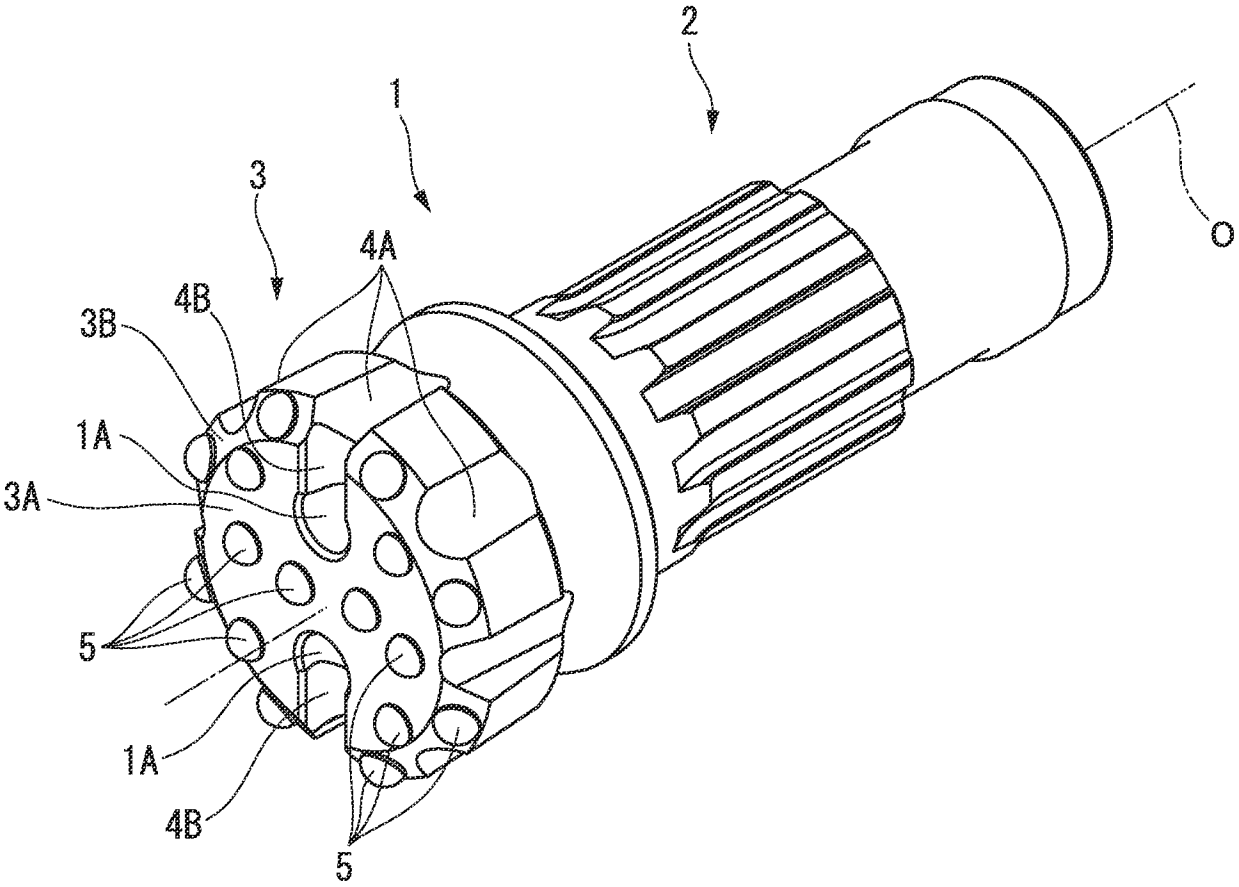
FIG. 1 is a perspective view of first to fourth embodiments of the present invention.

FIGS. 1 to 5B respectively illustrate first to fourth embodiments of the present invention. In these embodiments, a tool body 1 is formed of steel. As illustrated in FIG. 1, a distal end thereof (left side portion in FIG. 1, lower side portion in each B view of FIGS. 2A to 5B) has a large diameter. An outer diameter thereof is gradually decreased as the tool body 1 faces a rear end side (right side portion in FIG. 1, upper side portion in each B view of FIGS. 2A to 5B). The tool body 1 has a substantially multi-stage cylindrical shape centered on an axis line O.

A rear end portion of the tool body 1 serves as a shank portion 2. The shank portion 2 is attached to a down-the-hole hammer (not illustrated). In this manner, the tool body 1 receives a striking force to a distal end side in a direction of the axis line O from the down-the-hole hammer. In addition, an excavator is connected to the rear end of the down-the-hole hammer via an excavation rod (not illustrated). The tool body 1 receives a rotating force around the axis line O and a thrust force to the distal end side in the direction of the axis line O from the excavator.

A distal end portion 3 of the tool body 1 is configured so that an inner peripheral portion 3A of a distal end surface thereof has a circular surface which is perpendicular to the axis line O and is centered on the axis line O, and an outer peripheral portion 3B of the distal end surface serves as a tapered surface-shaped gauge portion which is tilted toward the rear end side as the tool body 1 faces an outer peripheral side. In addition, an outer peripheral surface of the distal end portion 3 connected to the rear end side of the outer peripheral portion 3B of the distal end surface thereof forms a tapered surface which is slightly tilted toward an inner peripheral side as the tool body 1 faces the rear end side. Thereafter, the outer peripheral surface forms a concavely curved shape, protrudes to the outer peripheral side and then is connected to the shank portion 2 via a step.

In order to discharge sludge repeatedly generated during excavation, multiple (eight in the present embodiment) outer peripheral discharge grooves 4A extending in parallel with the axis line O are formed at equal circumferential intervals, on the outer peripheral surface of the distal end portion 3 thereof. These outer peripheral discharge grooves 4A are configured so that a cross section orthogonal to the axis line O forms the concavely curved shape such as a concave arc. The radius from the axis line O to a groove bottom thereof is slightly larger than the radius of a circle formed by the inner peripheral portion 3A of the distal end surface.

Out of eight outer peripheral discharge grooves 4A, from a distal end of two outer peripheral discharge grooves 4A (vertically positioned outer peripheral discharge grooves in each A view of FIGS. 2A to 5B) positioned to be opposite to each other across the axis line O, distal end discharge grooves 4B are formed which extend to the inner peripheral portion 3A of the distal end surface toward the inner peripheral side to reach an approximately radius position of the circle formed by the inner peripheral portion 3A of the distal end surface. In addition, a blow hole 1A for compressed air is formed from the rear end to the distal end side along the axis line O in the tool body 1. The blow hole 1A is divided into two in the distal end portion 3 and is opened on an inner peripheral end of the distal end discharge groove 4B.

An excavation tip 5 is embedded in the inner peripheral portion 3A of the distal end surface and the outer peripheral portion 3B of the distal end surface of the distal end portion 3 of the tool body 1. The excavation tip 5 is formed of sintered alloys such as ultra-hard metal alloys which are harder than the tool body 1. As illustrated in FIGS. 6A to 12B, an embedding portion 6 of the rear end side (lower side in FIGS. 6A to 8B, 9A, 9C, 9E and 10A to 12B) which forms a substantially cylindrical shape centered on a central axis C is molded integrally with a cutting edge portion 7 of the distal end side (upper side in FIGS. 6A to 8B, 9A, 9C, 9E and 10A to 12B).

In the excavation tip 5 illustrated in FIGS. 6A to 12B, the cutting edge portion 7 forms a hemispherical shape which has a center on the central axis C and a radius slightly larger than the radius of the distal end of the embedding portion 6. However, the cutting edge portion 7 may form a conical shape whose distal end is rounded into a spherical shape and which is centered on the central axis C, or may form a bullet shape centered on the central axis C.

The above-described excavation tip 5 is embedded in such a manner that the embedding portion 6 is inserted into and embedded in an embedding hole 8 which is formed in the tool body 1 and is recessed in a substantially cylindrical shape. The excavation tip 5 is attached thereto so as to protrude the cutting edge portion 7. Then, in the first to fourth embodiments, the plurality of excavation tips 5 is attached to the distal end portion of the tool body 1. Out of the excavation tips, at least some of the excavation tips 5 illustrated by shading in FIGS. 2A to 5B are rotatable around the central axis C during the excavation, are locked so as not to slip toward the distal end side in the direction of the central axis C, and serve as a rotary excavation tip 5A attached to the embedding hole 8.

In any one of the first to fourth embodiments, the plurality of excavation tips 5 are respectively attached to the inner peripheral portion 3A of the distal end surface and the outer peripheral portion 3B of the distal end surface of the distal end portion 3 of the tool body 1. Out of the excavation tips 5, total of eight excavation tips (respectively one by one) are attached to the outer peripheral portion 3B of the distal end surface so that the respective excavation tips 5, one by one, have substantially equal intervals in a circumferential direction between the outer peripheral discharge grooves 4A which are adjacent to each other in the circumferential direction.

The excavation tip 5 embedded in the outer peripheral portion 3B of the distal end surface is embedded so that the central axis C extends toward the outer peripheral side as it faces the distal end side of the tool body 1 and is approximately perpendicular to the outer peripheral portion 3B of the distal end surface thereof. The maximum outer diameter from the axis line O of the cutting edge portion 7 of the excavation tip 5 embedded in the outer peripheral portion 3B of the distal end surface when viewed from the distal end side in the direction of the axis line O (diameter of the circle centered on the axis line O and circumscribing the cutting edge portion of the excavation tip 5 embedded in the outer peripheral portion 3B of the distal end surface when viewed from the distal end in the direction of the axis line O) is slightly larger than the maximum outer diameter of the distal end portion 3 of the tool body 1 (diameter of an intersection ridgeline between the outer peripheral portion 3B of the distal end surface and the outer peripheral surface of the distal end portion 3 which is connected to the rear end side thereof).

In addition, four excavation tips 5 are attached to the outer peripheral side inside the inner peripheral portion 3A of the distal end surface. The excavation tips 5 of the outer peripheral side inside the inner peripheral portion 3A of the distal end surface are attached so as to inscribe the circle formed by the inner peripheral portion 3A of the distal end surface when viewed from the distal end in the direction of the axis line O. In addition, the excavation tips 5 are attached at equal circumferential intervals so as to be positioned inside the outer peripheral discharge grooves 4A adjacent to both sides in the circumferential direction of two outer peripheral discharge grooves 4A which communicate with the distal end discharge grooves 4B, out of the outer peripheral discharge grooves 4A.

Furthermore, a plurality of (four) excavation tips 5 is also attached to the further inner peripheral side than the excavation tips 5 of the outer peripheral side of the inner peripheral portion 3A of the distal end surface. The excavation tips 5 of the inner peripheral side are attached so as to avoid the distal end discharge grooves 4B and the blow hole 1A, and are attached by being radially displaced so that mutual rotary orbits thereof around the axis line O occupy substantially the entire region of the circle formed by the inner peripheral portion 3A of the distal end surface excluding the extremely close region to the axis line O together with the excavation tips 5 of the outer peripheral side of the inner peripheral portion 3A of the distal end surface. The excavation tips 5 attached to the inner peripheral portion 3A of the distal end surface are configured so that the central axes C thereof are parallel with the axis line O, and protruding amounts of the cutting edge portions 7 in the direction of axis line O are uniform.

Figure 2A:
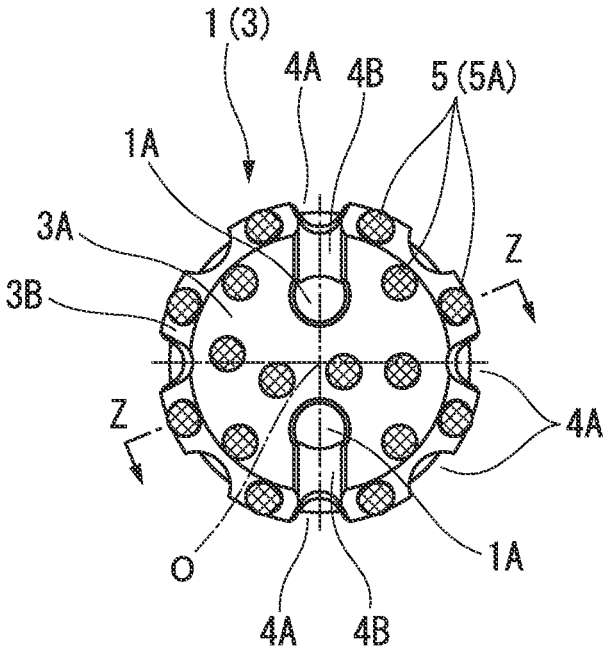
FIG. 2A is a front view illustrating the first embodiment of the present invention, when viewed from a distal end side in a direction of an axis line.
Figure 2B:
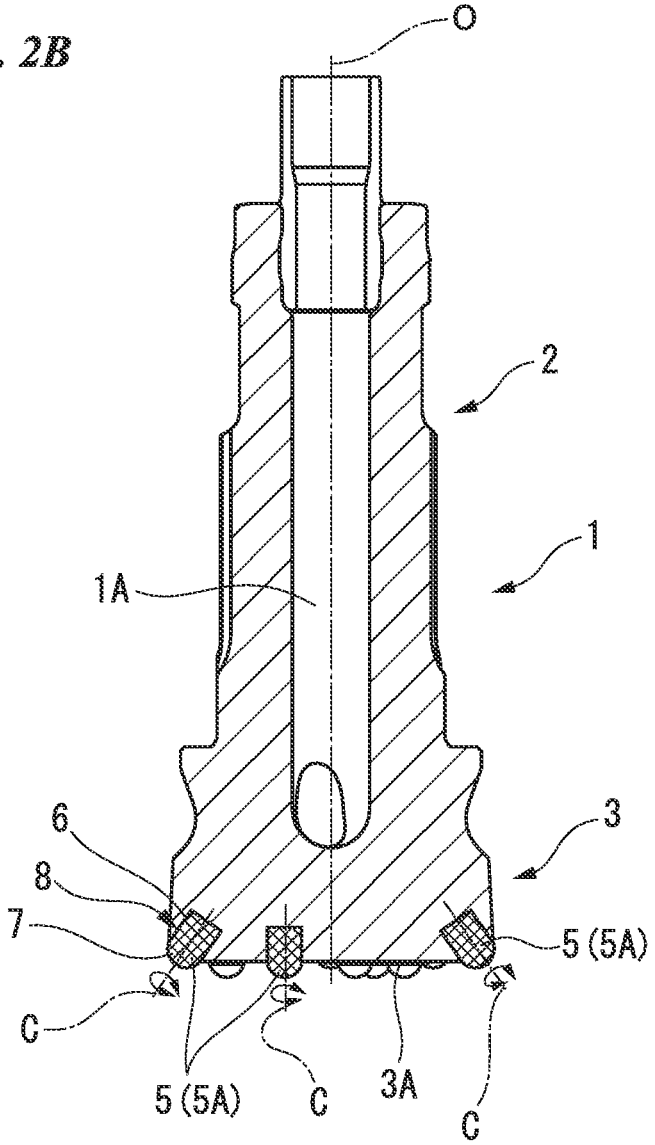
FIG. 2B is a cross-sectional view illustrating the first embodiment of the present invention, which is taken along line ZOZ in FIG. 2A.
Figure 3A:
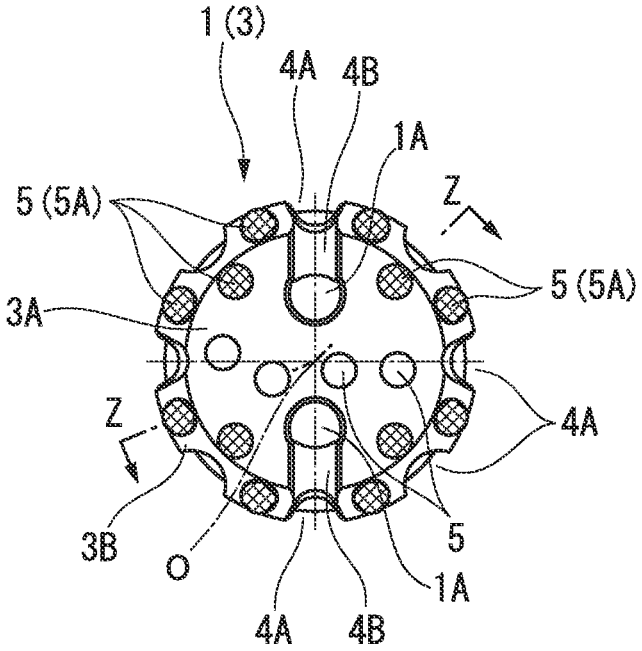
FIG. 3A is a front view illustrating the second embodiment of the present invention, when viewed from the distal end side in the direction of the axis line.
Figure 3B:
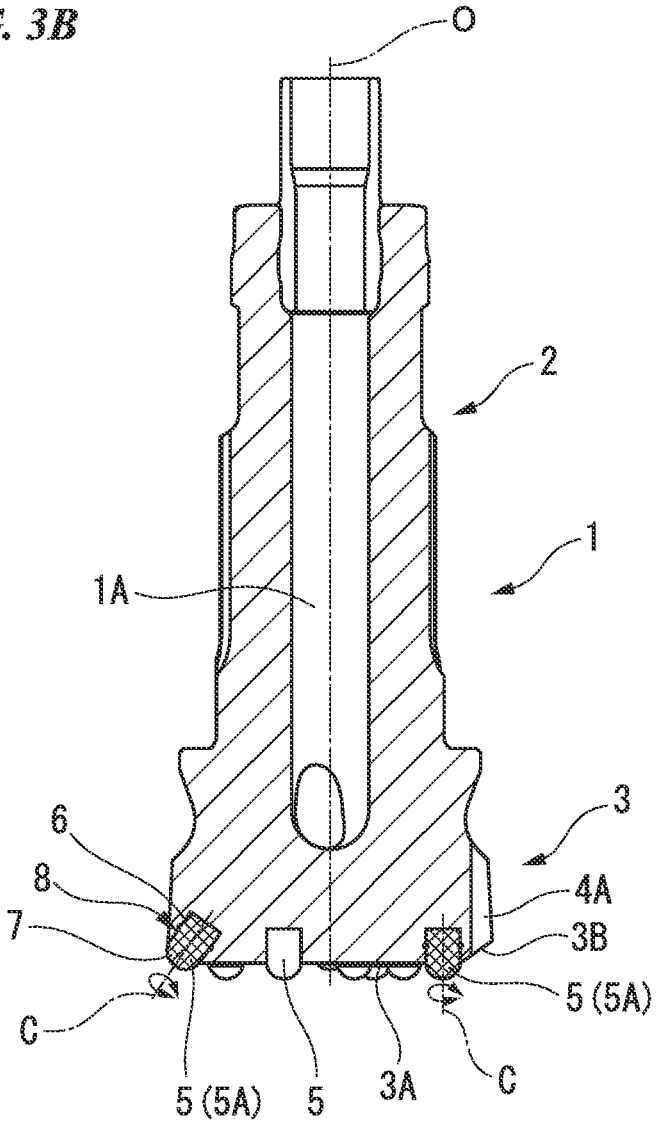
FIG. 3B is a cross-sectional view illustrating the second embodiment of the present invention, which is taken along line ZOZ in FIG. 3A.

In the first embodiment illustrated in FIGS. 2A and 2B, out of the first to fourth embodiments, all of the excavation tips 5 attached to the inner peripheral portion 3A of the distal end surface and the outer peripheral portion 3B of the distal end surface of the distal end portion 3 serve as a rotary excavation tip 5A. In addition, in the second embodiment illustrated in FIGS. 3A and 3B, the excavation tips 5 attached to the outer peripheral portion 3A and the excavation tips 5 of the outer peripheral side out of the excavation tips 5 attached to the inner peripheral portion 3A of the distal end surface serve as the rotary excavation tip 5A.

Figure 4A:
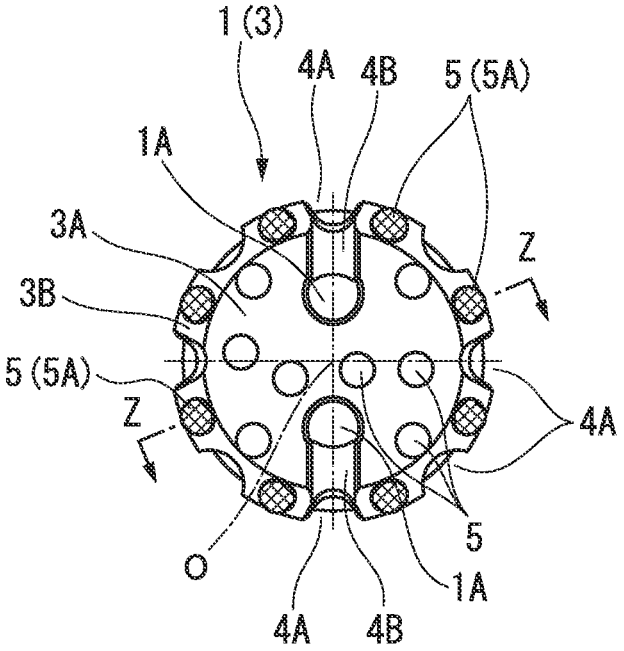
FIG. 4A is a front view illustrating the third embodiment of the present invention, when viewed from the distal end side in the direction of the axis line.
Figure 4B:
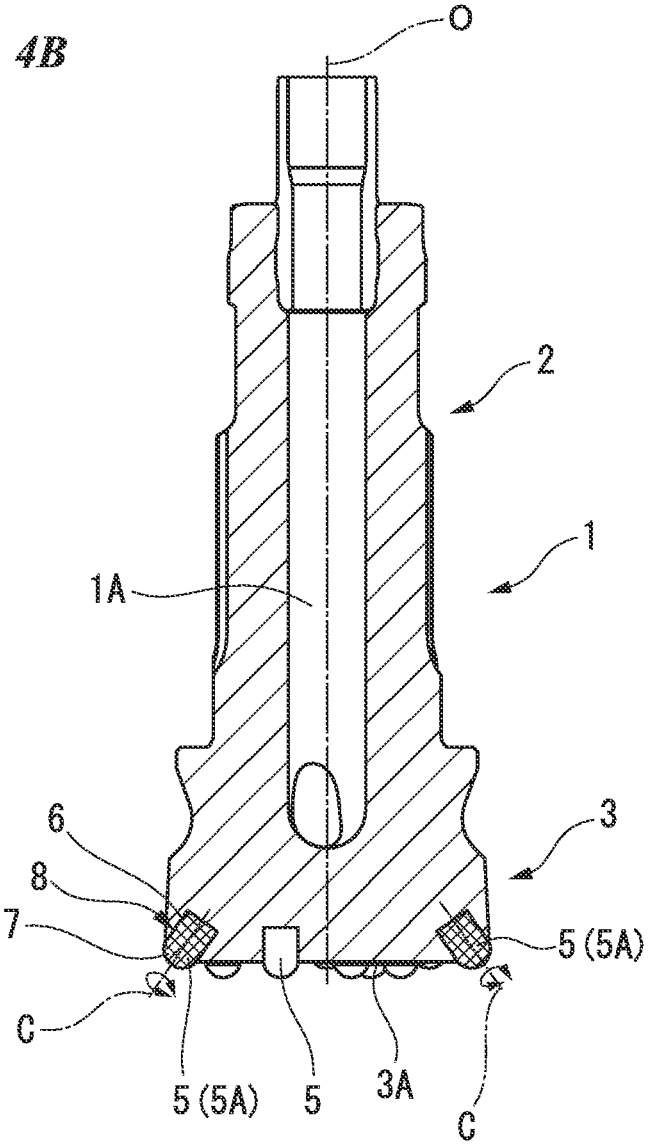
FIG. 4B is a cross-sectional view illustrating the third embodiment of the present invention, which is taken along line ZOZ in FIG. 4A.
Figure 5A:
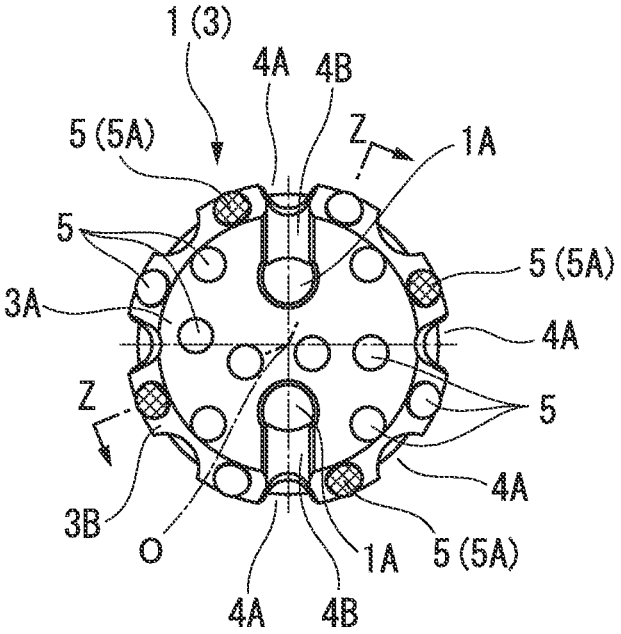
FIG. 5A is a front view illustrating the fourth embodiment of the present invention, when viewed from the distal end side in the direction of the axis line.
Figure 5B:
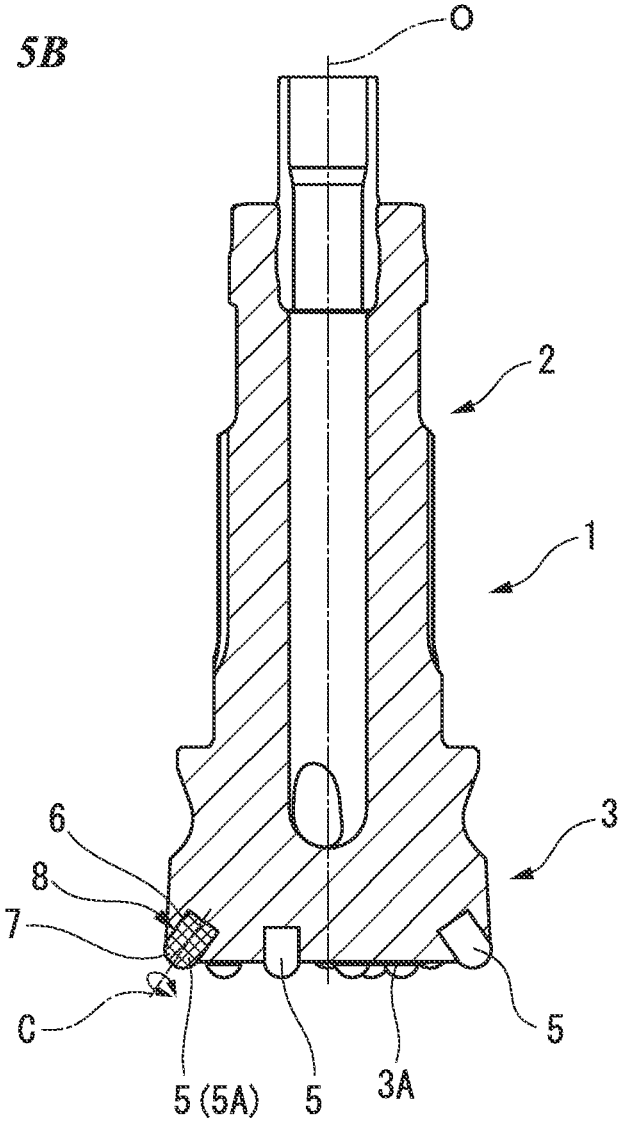
FIG. 5B is a cross-sectional view illustrating the fourth embodiment of the present invention, which is taken along line ZOZ in FIG. 5A.

Furthermore, in the third embodiment illustrated in FIGS. 4A and 4B, all of the excavation tips 5 attached to the outer peripheral portion 3B of the distal end surface serve as the rotary excavation tip 5A. In the fourth embodiment illustrated in FIGS. 5A and 5B, every other excavation tip 5 in the circumferential direction, that is, only four excavation tips 5 in total out of the excavation tips 5 attached to the outer peripheral portion 3B of the distal end surface, serve as the rotary excavation tip 5A. In the second to fourth embodiments, the excavation tips 5 other than the rotary excavation tip 5A are not allowed to be rotated around the central axis C even during the excavation, are in a non-rotating state, are locked so as not to slip toward the distal end side in the direction of the central axis C, and are firmly fixed to the tool body 1.

Here, in order to fix the excavation tips 5 other than the rotary excavation tip 5A to the tool body 1 without allowing the rotation around the central axis C in this manner, a relatively large interference is set between the outer diameter of the embedding portion 6 of the excavation tip 5 and the inner diameter of the embedding hole 8 of the tool body 1. Then, the embedding portion 6 is press-fitted to the embedding hole 8, or the embedding portion 6 is inserted into and shrink-fitted to the embedding hole 8 whose diameter is increased by heating the tool body 1. In this manner, the excavation tip 5 may be fixed to the tool body 1 by interference fit.

In contrast, first to sixteenth examples of attachment means when attaching the rotary excavation tip 5A to the embedding hole 8 by allowing the rotation around the central axis C during the excavation and locking the rotary excavation tip 5A so as not to slip toward the distal end side in the direction of the central axis C as described above will be described with reference to FIGS. 6A to 12B. Among the drawings, FIGS. 6A to 6C and 10A to 12B illustrate a case where the rotary excavation tip 5A is directly attached to the embedding hole 8. In addition, FIGS. 7A to 8B illustrate a case where the rotary excavation tip 5A is attached to the embedding hole 8 via an intermediate member. Furthermore, FIGS. 9A to 9F illustrate a case where the rotary excavation tip 5A is attached to the embedding hole 8 by using a locking member.

Figure 6A:
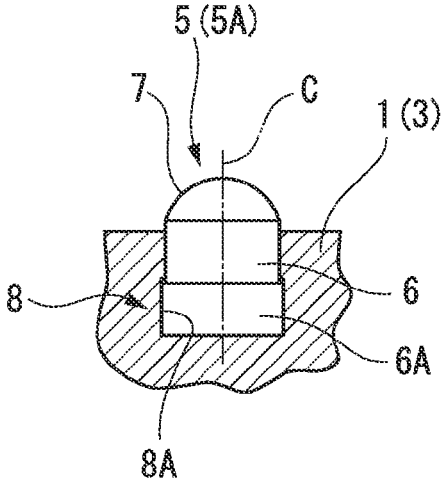
FIG. 6A is a cross-sectional view taken along a central axis, which illustrates a first example of a rotary excavation tip and an embedding hole according to the embodiments illustrated in FIGS. 1 to 5B.

In the first example illustrated in FIG. 6A, the rear end portion of the embedding portion 6 of the rotary excavation tip 5A has a cylindrical shape whose radius is slightly larger than that of the distal end portion of the embedding portion 6 by one stage. The rear end portion of the embedding portion 6 forms a convex portion 6A protruding to the outer peripheral side of the distal end portion in the radial direction with respect to the central axis C. In addition, the embedding hole 8 of the tool body 1 is configured so that the inner diameter of the distal end portion of the opening portion side thereof is slightly larger than the outer diameter of the distal end portion of the embedding portion 6 and is slightly smaller than the outer diameter of the convex portion 6A of the rear end portion of the embedding portion 6.

In contrast, the inner diameter of the rear end portion of the hole bottom side of the embedding hole 8 is larger than that of the distal end portion of the embedding hole 8 by one stage and is slightly larger than the outer diameter of the convex portion 6A of the rear end portion of the embedding portion 6. The rear end portion of the embedding hole 8 is formed so as to go around the central axis C and serves as a concave groove 8A for accommodating the convex portion 6A. The length of the convex portion 6A in the direction of the central axis C is slightly shorter than the length of the concave groove 8A in the direction of the central axis C.

Figure 6B:
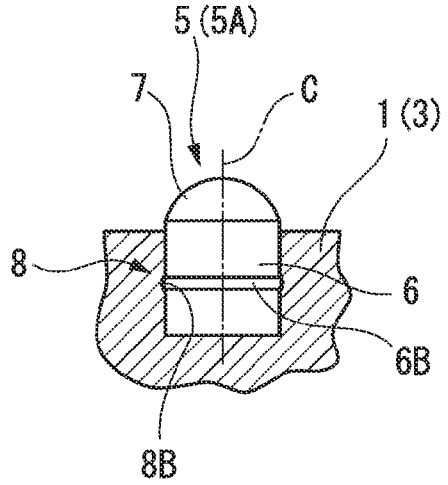
FIG. 6B is a cross-sectional view taken along the central axis, which illustrates a second example of the rotary excavation tip and the embedding hole according to the embodiments illustrated in FIGS. 1 to 5B.

In addition, in the second example illustrated in FIG. 6B, an annular convex portion 6B which slightly protrudes to the outer peripheral side in the radial direction with respect to the central axis C and goes around the central axis C is formed substantially in the center in the direction of the central axis C of the embedding portion 6 of the rotary excavation tip 5A. A cross section along the central axis C of the convex portion 6B has a convexly curved shape such as a convex arc, for example. In contrast, in the embedding hole 8 of the tool body 1, a concave groove 8B whose cross section has a concavely curved shape such as a concave arc and which can accommodate the convex portion 6B is also formed at a position corresponding to the convex portion 6B in the direction of the central axis C so as to go around the central axis C.

The outer diameter of the convex portion 6B is larger than the inner diameter of the embedding hole 8 excluding the concave groove 8B, and is slightly smaller than the inner diameter of the concave groove 8B. In addition, the radius of the convexly curved line such as the convex arc formed by the cross section of the convex portion 6B is slightly smaller than the radius of the concavely curved line such as the concave arc formed by the cross section of the concave groove 8B. Furthermore, the outer diameter of the embedding portion 6 in a portion excluding the convex portion 6B is slightly smaller than the inner diameter of the embedding hole 8 in a portion excluding the concave groove 8B.

Figure 6C:
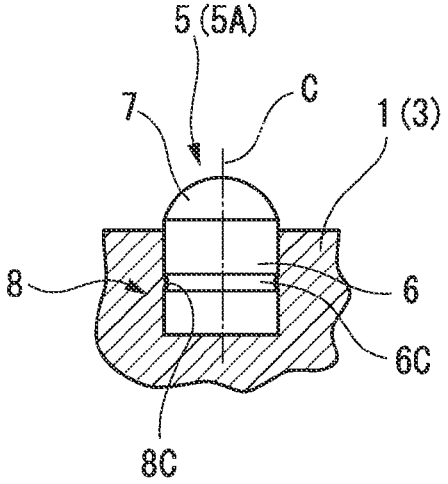
FIG. 6C is a cross-sectional view taken along the central axis, which illustrates a third example of the rotary excavation tip and the embedding hole according to the embodiments illustrated in FIGS. 1 to 5B.

In contrast, in the third example illustrated in FIG. 6C, contrary to the second example illustrated in FIG. 6B, an annular concave groove 6C which is slightly recessed on the inner peripheral side in the radial direction with respect to the central axis C and goes around the central axis C is formed substantially in the center in the direction of the central axis C of the embedding portion 6 of the rotary excavation tip 5A. A cross section along the central axis C of the concave groove 6C has a concavely curved shape such as a concave arc, for example. In contrast, in the embedding hole 8 of the tool body 1, a convex portion 8C whose cross section has a convexly curved shape such as a convex arc and which can be accommodated in the concave groove 6C is formed at a position corresponding to the concave groove 6C in the direction of the central axis C so as to go around the central axis C. The inner diameter of the convex portion 8C is larger than the outer diameter of the concave groove 6C and is smaller than the outer diameter of the embedding portion 6 in the portion excluding the concave groove 6C.

In the first to third examples, the outer diameter of the portion excluding the convex portions 6A and 6B and the concave groove 6C within the embedding portion 6 of the rotary excavation tip 5A is slightly smaller than the inner diameter of the portion excluding the concave grooves 8A and 8B and the convex portion 8C within the embedding hole 8. The outer peripheral surface of the embedding portion 6 is fitted to and inserted into the inner peripheral surface of the embedding hole 8 with a gap for slidable contact in a clearance fit manner. Then, the convex portions 6A, 6B and 8C are accommodated in and locked by the concave grooves 8A, 8B and 6C. In this manner, the rotary excavation tip 5A is allowed to be rotated around the central axis C during the excavation and non-excavation, in a state where the rotary excavation tip 5A is locked so as not to slip toward the distal end side in the direction of the central axis C.

In order to insert the above-described embedding portion 6 of the rotary excavation tip 5A into the embedding hole 8 of the tool body 1, by utilizing a difference in the Young's modulus between the tool body 1 made of steel and the rotary excavation tip 5A made of sintered alloys such as ultra-hard metal alloys, it is preferable to elastically deform the tool body 1 around the embedding hole 8 by press-fitting the embedding portion 6 to the embedding hole 8 and to accommodate the convex portions 6A, 6B and 8C in the concave grooves 8A, 8B and 6C. Alternatively, after inserting the embedding portion 6 of the rotary excavation tip 5A into the embedding hole 8 whose diameter is increased by heating the distal end portion 3 of the tool body 1 so as to be thermally expanded, the tool body 1 is cooled and the embedding hole 8 is contracted. In this manner, the convex portions 6A, 6B and 8C may be accommodated in the concave grooves 8A, 8B and 6C.

Figure 7A:
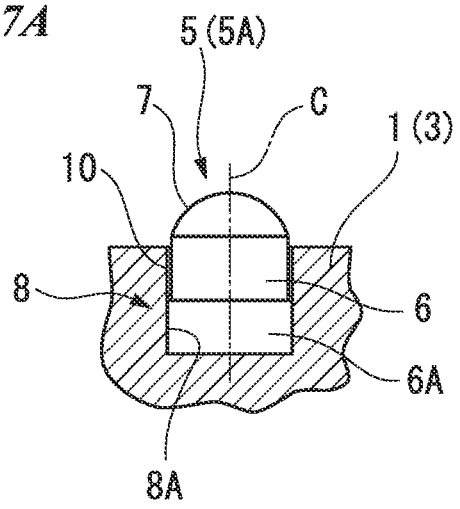
FIG. 7A is a cross-sectional view taken along the central axis, which illustrates a fourth example of the rotary excavation tip and the embedding hole according to the embodiments illustrated in FIGS. 1 to 5B.
Figure 7B:
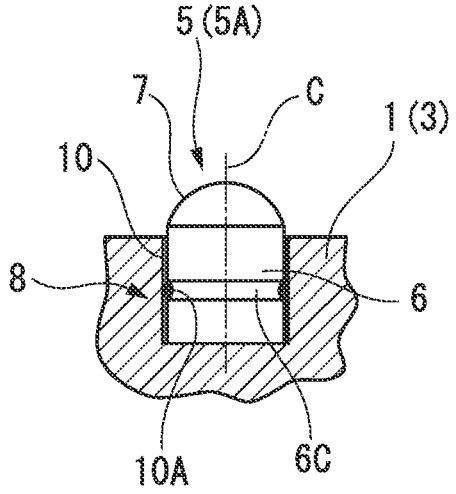
FIG. 7B is a cross-sectional view taken along the central axis, which illustrates a fifth example of the rotary excavation tip and the embedding hole according to the embodiments illustrated in FIGS. 1 to 5B.

Next, in the fourth and fifth examples illustrated in FIGS. 7A and 7B, an intermediate member 10 is attached to an inner periphery of the embedding hole 8 of the tool body 1. In addition, in the sixth and seventh examples illustrated in FIGS. 8A and 8B, contrary to the fourth and fifth examples, the intermediate member 10 is attached to an outer periphery of the embedding portion 6 of the rotary excavation tip 5A. In this manner, the rotary excavation tips 5A are respectively locked so as not to slip by forming the concave groove or the convex portion and are rotatable during the excavation.

Out of the examples, in the fourth example illustrated in FIG. 7A, similar to in the first example, the embedding portion 6 of the rotary excavation tip 5A has a multi-stage cylindrical shape in which the rear end portion has the radius which is slightly larger than that of the distal end portion by one stage, and forms the convex portion 6A which protrudes to the outer peripheral side of the distal end portion in the radial direction with respect to the central axis C. On the other hand, the embedding hole 8 of the tool body 1 has a constant inner diameter which can accommodate the convex portion 6A throughout the direction of the central axis C.

The intermediate member 10 in the fourth example is a cylindrical member, and is formed of the steel similar to the tool body 1. The outer diameter of the intermediate member 10 is slightly larger than the inner diameter of the embedding hole 8 before being attached to the embedding hole 8. In addition, the inner diameter of the intermediate member 10 is smaller than the outer diameter of the rear end portion serving as the convex portion 6A within the embedding portion 6 of the rotary excavation tip 5A after being attached to the embedding hole 8. The intermediate member 10 is configured to have the inner diameter which is larger than the outer diameter of the further distal end side of the embedding portion 6.

The above-described intermediate member 10 in the fourth example is fixed to the inner peripheral surface of the embedding hole 8 by interference fit as follows. After the embedding portion 6 of the rotary excavation tip 5A is inserted into the embedding portion 6, the intermediate member 10 is pressed into a portion between the inner periphery of the embedding hole 8 and the outer periphery of the distal end portion of the embedding portion 6 by press fitting, or is inserted into the embedding hole 8 whose diameter is increased by heating the tool body 1 so as to be thermally expanded. Therefore, the concave groove 8A in which the convex portion 6A of the embedding portion 6 is accommodated is formed inside the embedding hole 8 which is further on the rear end side than the intermediate member 10 fixed in this manner.

In addition, in the fifth example illustrated in FIG. 7B, similar to in the third example, the rotary excavation tip 5A is configured to have the annular concave groove 6C going around the central axis C substantially in the center in the direction of the central axis C of the embedding portion 6. The embedding hole 8 has a constant inner diameter which is slightly larger than the outer diameter of the embedding portion 6 of the rotary excavation tip 5A by one stage. Then, the cylindrical intermediate member 10 is inserted into and interposed between the embedding portion 6 and the embedding hole 8 by interference fit.

Similar to the convex portion 8C in the third example, a convex portion 10A is formed at a position corresponding to the concave groove 6C of the embedding portion 6 in the direction of the central axis C on the inner peripheral surface of the intermediate member 10 so as to go around the central axis C. The convex portion 10A has the inner diameter which is smaller than the outer diameter of the portion excluding the concave groove 6C of the embedding portion 6, and can be accommodated in the concave groove 6C. The inner diameter of the intermediate member 10 of the portion excluding the convex portion 10A is slightly larger than the outer diameter of the embedding portion 6 of the portion excluding the concave groove 6C.

The above-described intermediate member 10 in the fifth example is interference-fitted and fixed to the embedding hole 8 by press fitting or by shrink fitting using thermal expansion. Next, the embedding portion 6 of the rotary excavation tip 5A is press-fitted to the intermediate member 10 fixed in this manner, or the embedding portion 6 of the rotary excavation tip 5A is inserted into the inner peripheral portion of the intermediate member 10 whose diameter is increased by heating the tool body 1 together with the intermediate member 10 to be thermally expanded. Then, the convex portion 10A is accommodated in the concave groove 6C, and the other portion is gap-fitted. The rotary excavation tip 5A is rotatable during the excavation, and is attached thereto being locked so as not to slip. Alternatively, in contrast, the intermediate member 10 in which the embedding portion 6 of the rotary excavation tip 5A is clearance-fitted to the inner peripheral portion is interference-fitted to the embedding hole 8 together with rotary excavation tip 5A. In this manner, the intermediate member 10 may be attached to the embedding hole 8 by increasing the diameter thereof.

Figure 8A:
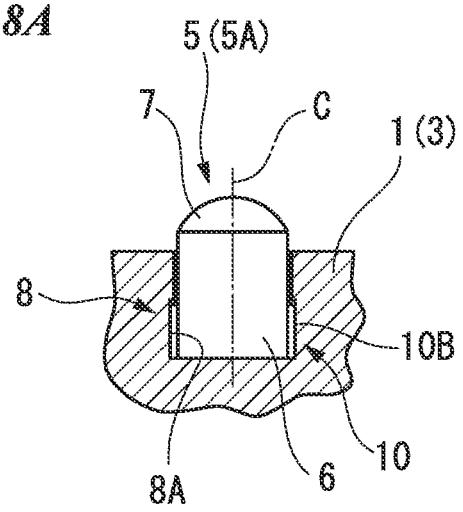
FIG. 8A is a cross-sectional view taken along the central axis, which illustrates a sixth example of the rotary excavation tip and the embedding hole according to the embodiments illustrated in FIGS. 1 to 5B.
Figure 8B:
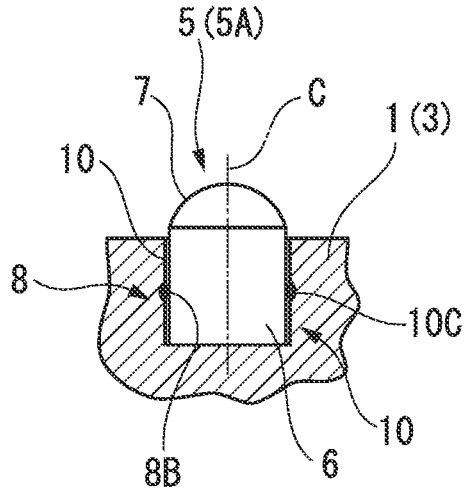
FIG. 8B is a cross-sectional view taken along the central axis, which illustrates a seventh example of the rotary excavation tip and the embedding hole according to the embodiments illustrated in FIGS. 1 to 5B.

Furthermore, in the sixth and seventh examples illustrated in FIGS. 8A and 8B, the rotary excavation tip 5A itself does not have the convex portions 6A and 6B and the concave groove 6C in the embedding portion 6. Similar to the other excavation tips 5 whose rotation is restricted, the embedding portion 6 keeps the cylindrical shape having a constant outer diameter which is centered on the central axis C. Then, the tubular intermediate member 10 whose inner diameter is slightly smaller than the outer diameter of the embedding portion 6 before being attached is attached and fixed to the outer periphery of the embedding portion 6 by interference fit in such a manner that the embedding portion 6 is press-fitted to the inner peripheral portion of the intermediate member 10 or the embedding portion 6 is inserted into the inner peripheral portion of the intermediate member 10 whose diameter is increased by thermal expansion.

Here, in the sixth example illustrated in FIG. 8A, the length in the direction of the central axis C of the intermediate member 10 is approximately equal to the depth of the embedding hole 8. However, the outer diameter of the rear end portion side of the embedding portion 6 is larger than that of the distal end portion side by one stage. The rear end portion side whose diameter is larger by one stage serves as a convex portion 10B. In addition, similar to in the first example, the concave groove 8A is formed in the rear end portion of the embedding hole 8 of the tool body 1 in such a manner that the inner diameter of the rear end portion of the bole bottom side is slightly larger than the inner diameter of the distal end portion of the opening portion side by one stage. The convex portion 10B of the intermediate member 10 which is attached to the rotary excavation tip 5A is accommodated in the concave groove 8A. Furthermore, the inner diameter of the distal end portion of the embedding hole 8 of the further opening portion side than the concave groove 8A is smaller than the outer diameter of the convex portion 10B, and is slightly larger than the outer diameter of the distal end portion of the intermediate member 10.

In addition, even in the seventh example illustrated in FIG. 8B, the length in the direction of the central axis C of the intermediate member 10 is approximately equal to the depth of the embedding hole 8. A convex portion 10C which forms a convexly curved shape in cross section and slightly protrudes to the outer peripheral side in the radial direction is formed in an annular shape going around the central axis C substantially in the central portion in the direction of the central axis C of the outer peripheral portion thereof. The concave groove 8B forming the concavely curved shape in cross section similar to in the second example is formed at a position corresponding to the convex portion 10C in the direction of the central axis C of the embedding hole 8 so as to go around the central axis C. The convex portion 10C is accommodated in the concave groove 8B.

In addition, in the eighth to tenth examples illustrated in FIGS. 9A to 9F in which the rotary excavation tip 5A is attached by using a locking member, a concave groove 6D going around the central axis C is formed on the outer peripheral surface of the embedding portion 6. In the eighth and tenth examples out of the examples, a concave groove 8D similarly going around the central axis C is formed at a position corresponding to the concave groove 6D in the direction of the central axis C of the inner peripheral surface of the embedding hole 8. In addition, in the ninth example, an opening portion to the inner peripheral surface of the embedding hole 8 of a pothole 8E drilled on the tool body 1 so as to extend in the tangential direction of the circling concave groove 6D in the cross section orthogonal to the central axis C is formed at a position corresponding to the concave groove 6D of the inner peripheral surface of the embedding hole 8. In the eighth to tenth examples, the embedding portion 6 is clearance-fitted to the embedding hole 8.

Figure 9A:
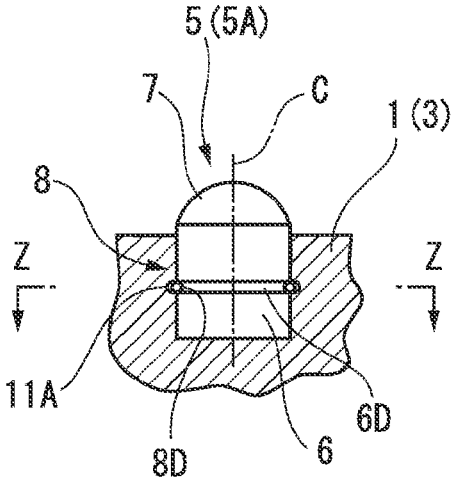
FIG. 9A is a cross-sectional view taken along the central axis, which illustrates an eighth example of the rotary excavation tip and the embedding hole according to the embodiments illustrated in FIGS. 1 to 5B.
Figure 9B:
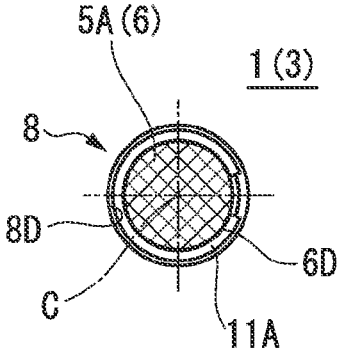
FIG. 9B is a cross-sectional view taken along line ZZ in FIG. 9A, which illustrates the rotary excavation tip and the embedding hole according to the embodiments illustrated in FIGS. 1 to 5B.

In the eighth example illustrated in FIGS. 9A and 9B, the concave groove 6D is configured to have a U-shaped cross section taken along the central axis C, for example. The concave groove 8D has a semicircular shape in cross section having the diameter equal to the groove width of the concave groove 6D. As the locking member, a C-type ring 11A formed of an elastically deformable material such as spring steel is accommodated in the above-described concave grooves 6D and 8D. The cross section of the C-type ring 11A is a circle having a size which can be in close contact with a semicircle formed by the cross section of the concave groove 8D.

The above-described C-type ring 11A is accommodated inside the concave groove 6D by being elastically deformed and decreasing in diameter. Then, the embedding portion 6 is inserted into the embedding hole 8 in a state where the C-type ring 11A is accommodated in this way. After the concave groove 6D and the concave groove 8D are coincident with each other, the C-type ring 11A is caused to increase in diameter by elasticity so as to be accommodated in both of the concave grooves 6D and 8D. In this manner, the rotary excavation tip 5A is rotatable around the central axis C and is locked so as not to slip toward the distal end side in the direction of the central axis C.

Figure 9C:
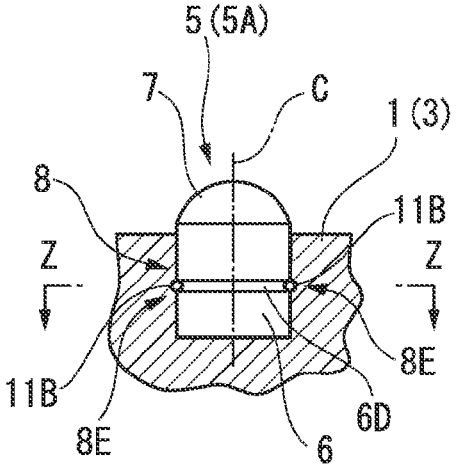
FIG. 9C is a cross-sectional view taken along the central axis, which illustrates a ninth example of the rotary excavation tip and the embedding hole according to the embodiments illustrated in FIGS. 1 to 5B.
Figure 9D:
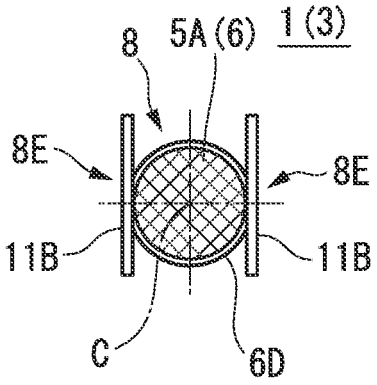
FIG. 9D is a cross-sectional view taken along line ZZ in FIG. 9C, which illustrates the rotary excavation tip and the embedding hole according to the embodiments illustrated in FIGS. 1 to 5B.

In addition, in the ninth example illustrated in FIGS. 9C and 9D, the concave groove 6D of the rotary excavation tip 5A has a semicircular shape in cross section. The pothole 8E has the inner diameter having the size equal to the diameter of the semicircle formed by the cross section of the concave groove 6D. In this ninth example, as illustrated in FIG. 9D, two potholes 8E are formed for one embedding hole 8 in the tool body 1 so as to extend on one plane orthogonal to the central axis C, by interposing the central axis C therebetween and being in parallel with each other to the sides opposite to each other.

These potholes 8E extend in a direction where a central line thereof comes into contact with the inner peripheral surface of the embedding hole 8 on the above-described plane and are open on the inner peripheral surface. In this manner, the potholes 8E extend in the tangential direction of the concave groove 6D. In a tangential point thereof, the opening portion on the inner peripheral surface of the embedding hole 8 is coincident with the concave groove 6D to form a circle in cross section. Then, a cylindrical shaft-shaped pin 11B serving as the locking member is fitted to and inserted into the pothole 8E so as not to slip. The pin 11B is accommodated in both the opening portion and the concave groove 6D. In this manner, the rotary excavation tip 5A is allowed to be rotated around the central axis C, and is locked so as not to slip toward the distal end side in the direction of the central axis C.

Figure 9E:
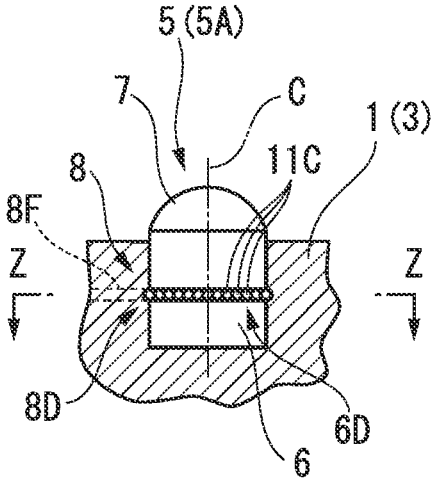
FIG. 9E is a cross-sectional view taken along the central axis, which illustrates a tenth example of the rotary excavation tip and the embedding hole according to the embodiments illustrated in FIGS. 1 to 5B.
Figure 9F:
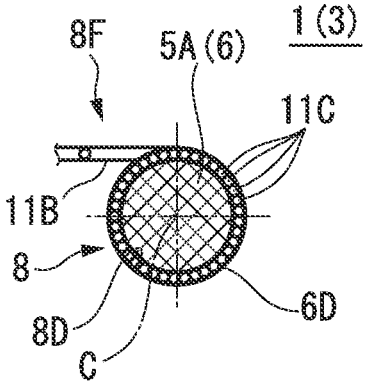
FIG. 9F is a cross-sectional view taken along line ZZ in FIG. 9E, which illustrates the rotary excavation tip and the embedding hole according to the embodiments illustrated in FIGS. 1 to 5B.

Furthermore, in the tenth example illustrated in FIGS. 9E and 9F, the concave groove 6D of the rotary excavation tip 5A also has a semicircular shape in cross section. The concave groove 8D of the inner peripheral surface of the embedding hole 8 also has the semicircular shape in cross section having the radius equal to that of the concave groove 6D. In addition, in the tool body 1, potholes 8F having the inner diameter of the radius equal to those of the concave grooves 6D and 8D are drilled toward the concave groove 8D for one embedding hole 8 so as to communicate with the concave groove 8D.

Then, multiple balls 11C are fed, through the pothole 8F, into an annular hole which is formed by the concave grooves 6D and 8D being coincident with each other and has circular shape in cross section, and are accommodated in both of the concave grooves 6D and 8D as the locking member. After the balls 11C are accommodated in this way, a pin (not illustrated) is inserted into the pothole 8F, thereby causing the balls 11C to slip out from the annular hole. Therefore, rolling of the balls 11C enables the rotary excavation tip 5A to be rotated around the central axis C and to be locked so as not to slip toward the distal end side in the direction of the central axis C.

In the excavation tool configured as described above, the excavation tip 5 serving as the rotary excavation tip 5A in this way is rotatable around the central axis C thereof. As the tool body 1 is rotated around the axis line O during the excavation, the rotary excavation tip 5A is also driven to rotate around the central axis C by the contact resistance from the ground or the rock. Therefore, in the rotary excavation tip 5A, the cutting edge portion 7 is also uniformly worn in the circumferential direction due to the excavation. Accordingly, it is possible to prevent the cutting edge portion 7 from being partially and asymmetrically worn. It is possible to reduce significant degradation in excavation performance or excavation efficiency by preventing the radius of curvature of a curved surface configuring the cutting edge portion 7 from increasing in size.

For example, in the excavation tool in the related art where all excavation tips were fixed to the tool body so as not to be rotatable, the excavation tool will be described as an example where the maximum outer diameter from the axis line O of the cutting edge portion of the excavation tip which is embedded in the outer peripheral portion of the distal end surface when viewed from the distal end side in the direction of the axis line O of the tool body was 152 mm. The excavation work was carried out under predetermined conditions. The excavation tips embedded on the outer peripheral portion of the distal end surface had the cutting edge portions asymmetrically worn and the diameters thereof were respectively decreased by 2 mm in the inner peripheral side. When the maximum outer diameter was 148 mm, the life of the excavation tip was finished. At this time, the wear amount of the excavation tip was 2.9 grams.

However, in the excavation tool according to the present invention, in which the excavation tip embedded in the outer peripheral portion of the distal end surface serves as the rotary excavation tip 5A, even though the rotary excavation tip 5A is similarly worn by 2.9 grams, the cutting edge portion 7 was uniformly worn in the circumferential direction. In this case, the amount of the decreased diameter was 0.64 mm and the maximum outer diameter of the cutting edge portion was 150.7 mm. Therefore, it was found that the tool life can be extended more than three times as compared to that of the excavation tool in the related art.

For this reason, according to the excavation tool configured as described above, even under conditions where the cutting edge portion is seriously worn due to the hard ground or rock, it is not necessary to regrind the cutting edge portion 7. Accordingly, it is possible to extend the tool life and to reduce the excavation cost per unit depth for the excavation pit. On the other hand, even when the rotatable excavation tip 5A is rotatable around the central axis C in this way, the rotary excavation tip 5A is locked so as not to slip toward the distal end side in the direction of the central axis C and is held by the embedding hole 8. Therefore, as in the other excavation tip 5 embedded in the tool body 1 so as not to be rotatable, the excavation tip 5 does not fall from the tool body 1 and thus the excavation performance and excavation efficiency will not be degraded.

When a plurality of the excavation tips 5 is embedded in the tool body 1, as in the first embodiment illustrated in FIGS. 2A and 2B, all of the excavation tips 5 may serve as the rotatable excavation tip 5A. However, whereas the life of the above-described rotary excavation tip 5A can be extended by causing the cutting edge portion 7 to be uniformly worn, it is difficult for the rotary excavation tip 5A to ensure rigidity in the attachment to the tool body 1 as compared to the excavation tip 5 which is fixed so as not to be rotatable. Therefore, there is a possibility that it may become difficult to propagate the striking force and the thrust force to the distal end side in the direction of the axis line O or the rotating force around the axis line O which are applied from the tool body 1 to the rotary excavation tip 5A to the ground or the rock.

Therefore, in this case, as in the second to fourth embodiments illustrated in FIGS. 3A to 5B, out of a plurality of the excavation tips 5, some of the excavation tips 5 may serve as the rotary excavation tip 5A, and the remaining excavation tips 5 may be attached to the tool body 1 so as not to be rotatable. The excavation tip 5 fixed so as not to be rotatable enables the excavation pit to be formed by directly propagating the striking force, the thrust force or the rotating force to the ground or the rock. The rotary excavation tip 5A enables the tool life to be extended.

However, when some of the excavation tips 5 serve as the rotary excavation tip 5A and the remaining is not rotatable in this way, the excavation tip 5 embedded in the inner peripheral portion 3A of the distal end surface of the distal end portion 3 of the tool body 1 may serve as the rotary excavation tip 5A, and the remaining excavation tips 5 embedded in the outer peripheral portion 3B of the distal end surface may not be rotatable. However, the excavation tip 5 of the inner peripheral portion 3A of the distal end surface is exclusively used as the excavation tip 5 for forming the excavation pit by crushing the ground or the rock. Accordingly, if the above-described excavation tip 5 serves as the rotary excavation tip 5A, there is a possibility that it may become difficult to efficiently carry out the crushing work by sufficiently propagating the above-described striking force, thrust force or rotating force to the ground or the rock.

Therefore, when some of the excavation tips 5 serve as the rotary excavation tip 5A in this way, as in the second to fourth embodiments, it is desirable to arrange at least one rotary excavation tip 5A in the outer peripheral portion 3B of the distal end surface by causing the excavation tip 5 which is fixed to the tool body 1 so as not to be rotatable to remain in the inner peripheral portion 3A of the distal end surface of the tool body 1. The excavation tip 5 which remains in the inner peripheral portion 3A of the distal end surface so as not to be rotatable in this way enables the excavation pit to be formed by efficiently crushing the ground or the rock. In contrast, the rotary excavation tip 5A arranged in the outer peripheral portion 3B of the distal end surface is uniformly worn. Accordingly, it is possible to extend the tool life by reliably increasing the diameter of the excavation pit up to a predetermined inner diameter over a long period of time.

In the first to fourth embodiments, as illustrated by shading in FIGS. 2A to 5B in this order, the number of rotary excavation tips 5A decreases from the inner peripheral portion 3A of the distal end surface to the outer peripheral portion 3B of the distal end surface. The excavation tool focusing on the extended tool life is shifted to the excavation tool focusing on efficient crushing of the ground or the rock. In addition, as in the second embodiment illustrated in FIGS. 3A and 3B, when the excavation tip 5 which is not rotatable and the rotary excavation tip 5A are arranged in the inner peripheral portion 3A of the distal end surface of the tool body 1, it is desirable to arrange the rotary excavation tip 5A in the outer peripheral side of the inner peripheral portion 3A of the distal end surface. Furthermore, it is desirable not to arrange the rotary excavation tip 5A coaxially with the axis line O.

In addition, in the respective embodiments, in order to attach the rotary excavation tip 5A which is rotatable around the central axis C and is locked so as not to slip toward the distal end side in the direction of the central axis C, as in the first to third examples illustrated in FIGS. 6A to 6C, first of all, the concave grooves 8A, 8B and 6C which go around the central axis C and the convex portions 6A, 6B and 8C which are accommodated in the concave grooves 8A, 8B and 6C are directly formed on the outer peripheral surface of the embedding portion 6 of the rotary excavation tip 5A and the inner peripheral portion of the embedding hole 8 of the tool body 1. Alternatively, as in the fourth to seventh examples illustrated in FIGS. 7A to 8B, the concave groove or the convex portion is formed in the intermediate member 10 attached to the outer peripheral surface of the embedding portion 6 or the inner peripheral surface of the embedding hole 8.

In the first to third examples out of the examples, it is necessary to form the concave grooves 8A, 8B and 6C or the convex portions 6A, 6B and 8C in both of the embedding portion 6 of the excavation tip 5 and the embedding hole 8 of the tool body 1. However, in this case, it is advantageous in that the number of parts can be decreased. In contrast, in the fourth to seventh examples, the number of parts is increased for only the intermediate member 10. However, an advantageous effect can be obtained in that processing work of the embedding portion 6 of the excavation tip 5 or the embedding hole 8 of the tool body 1 is facilitated.

On the other hand, in order to similarly attach the rotary excavation tip 5A which is rotatable around the central axis C and is locked so as not to slip toward the distal end side in the direction of the central axis C, in the eighth to tenth examples illustrated in FIGS. 9A to 9F, second of all, the concave groove 6D is formed in the embedding portion 6, and the opening portions of the concave groove 8D and the potholes 8E and 8F which go around the central axis C are also formed on the inner peripheral surface of the embedding hole 8. In this manner, the rotary excavation tip 5A is attached by using the locking member which is accommodated in both of the concave grooves 6D and 8D and the pothole 8E.

In the eighth to tenth examples, which employ the C-type ring 11A, the pin 11B and the ball 11C as the locking member, although the processing work for the embedding portion 6 and the embedding hole 8 is complicated and the number of parts is increased, it is possible to attach the rotary excavation tip 5A without depending on the press fitting or the thermal expansion by heating. Accordingly, it is possible to prevent distortion from occurring in the tool body 1 or the rotary excavation tip 5A. In addition, in the eighth to tenth examples, when the cutting edge portion 7 of the rotary excavation tip 5A is worn, it is relatively easy to replace the rotary excavation tip 5A.

In the first to seventh examples, it is necessary to form the concave grooves 8A, 8B and 6C so as to go around the central axis C. However, the convex portions 6A, 6B and 8C which are to be accommodated in the concave grooves 8A, 8B and 6C may be formed so as to similarly go around the central axis C, or may be formed at intervals in the circumferential direction around the central axis C so as to be dispersed. The rotary excavation tip 5A may be attached to the inner peripheral portion 3A of the distal end surface of the tool body 1 by employing the first to third examples in which the attachment rigidity is relatively high. The rotary excavation tip 5A may be attached to the outer peripheral portion 3B of the distal end surface by employing the fourth to tenth examples. In this manner, a plurality of the rotary excavation tips 5A may be attached to one tool body 1 by using different attachment means.

On the other hand, in the attachment means of the first to tenth examples, the rotary excavation tip 5A is attached to be rotatable around the central axis C not only during the excavation but also while the excavation work is not carried out. However, as in the attachment means of the eleventh to sixteenth examples illustrated in FIGS. 10A to 12B, the embedding portion 6 of the rotary excavation tip 5A may be fitted into and attached to the embedding hole 8 in the following interference fit. The interference with respect to an outer diameter d (mm) of the embedding portion 6 is in a range of 0.5×d/1000 (mm) to 1.5×d/1000 (mm), and more preferably 1.0×d/1000 (mm). The above-described interference is smaller than the interference when attaching the excavation tip 5 which is not rotatable with respect to the embedding hole 8 of the tool body 1 by interference fit.

Figure 10A:
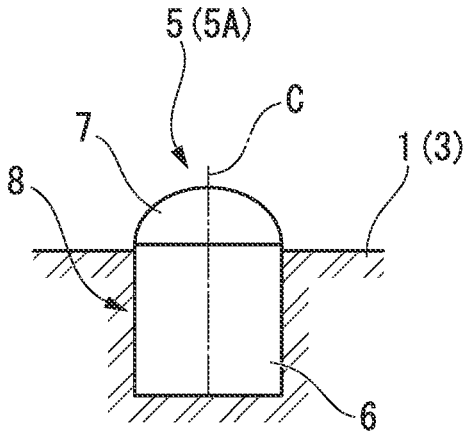
FIG. 10A is a cross-sectional view taken along the central axis, which illustrates an eleventh example of the rotary excavation tip and the embedding hole according to the embodiments illustrated in FIGS. 1 to 5B.

Here, in the eleventh examples illustrated in FIG. 10A, the embedding portion 6 of the rotary excavation tip 5A forms a cylindrical shape having the above-described constant outer diameter d (mm) which is centered on the central axis C. The embedding hole 8 also forms a hole recessed in a cylindrical shape having the constant inner diameter (mm) so as to be centered on the central axis C. Then, the outer diameter of the embedding portion 6 before the rotary excavation tip 5A is fitted and attached is larger than the inner diameter of the embedding hole 8. The above-described interference represents the difference between the outer diameter of the embedding portion 6 before the rotary excavation tip 5A is fitted and attached and the inner diameter of the embedding hole 8.

In this manner, if interference fit is performed by using the interference in the range smaller than that of the excavation tip 5 which is not rotatable, although the rotary excavation tip 5A is not rotatable during the non-excavation, the contact resistance is generated from the ground or the rock according to the rotation of the tool body 1 during the excavation. This contact resistance enables the rotary excavation tip 5A to be driven to be rotatable around the central axis C by bringing the outer peripheral surface of the embedding portion 6 into sliding contact with the inner peripheral surface of the embedding hole 8. In addition, in a state where the axis line O is aligned along the vertical direction and the tool body 1 is held by causing the distal end portion 3 to face downward, the rotary excavation tip 5A is arranged so as not to fall out from the embedding hole 8. In this manner, it is possible to lock the rotary excavation tip 5A so as not to slip toward the distal end side in the direction of the central axis C.

Figure 10B:
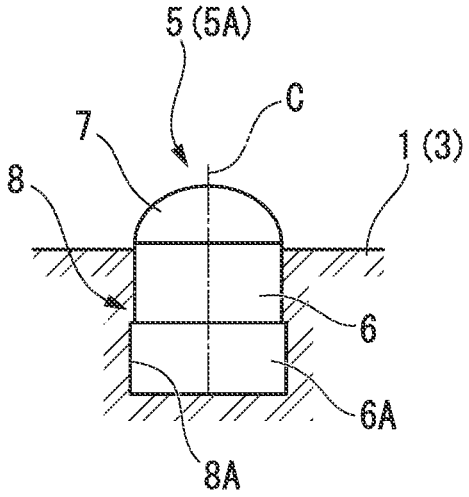
FIG. 10B is a cross-sectional view taken along the central axis, which illustrates a twelfth example of the rotary excavation tip and the embedding hole according to the embodiments illustrated in FIGS. 1 to 5B.

Next, in the twelfth example illustrated in FIG. 10B, similar to in the first example illustrated in FIG. 6A, the rear end portion of the embedding portion 6 of the rotary excavation tip 5A forms the convex portion 6A whose outer diameter is slightly larger than that of the distal end portion. The rear end portion of the embedding hole 8 forms the concave groove 8A whose inner diameter is also slightly larger than that of the distal end portion. Then, the convex portion 6A is attached in the following interference fit. The interference of the outer diameter d (mm) of the convex portion 6A with respect to the inner diameter (mm) of the concave groove 8A is in a range of 0.5·d/1000 (mm) to 1.5·d/1000 (mm). The distal end portion of the embedding portion 6 of the further distal end side than the convex portion 6A is also fitted in the following interference fit. The interference of the outer diameter d (mm) of the distal end portion with respect to the inner diameter (mm) of the distal end portion of the embedding hole 8 is in a range of 0.5·d/1000 (mm) to 1.5·d/1000 (mm).

Even by using the attachment means of the twelfth example as described above, the rotary excavation tip 5A is not rotatable during the non-excavation, but is rotatable during the excavation. In addition, in addition to the friction between the embedding portion 6 and the embedding hole 8, fitting of the convex portion 6A and the concave groove 8A also enables the rotary excavation tip 5A to be locked so as not to slip. However, in the twelfth embodiment, if the distal end portion of the embedding portion 6 is interference-fitted to the distal end portion of the embedding hole 8 by using the above-described interference, the convex portion 6A and the concave groove 8A may be clearance-fitted to each other. That is, the convex portion 6A and the concave groove 8A may be exclusively used in locking the rotary excavation tip 5A so as not to slip. In addition, contrarily, the convex portion 6A may be interference-fitted to the concave groove 8A by using the above-described interference, and the distal end portion of the embedding portion 6A may be clearance-fitted to the distal end portion of the embedding hole 8. Furthermore, the attachment means using the above-described interference fit can be applied to the other attachment means in the second to tenth examples.

On the other hand, in the attachment means of the first to twelfth examples described above, the rear end surface of the embedding portion 6 of the rotary excavation tip 5A is brought directly into contact with the hole bottom surface of the embedding hole 8 so as to be slidable, and the striking force or the thrust force against the distal end side in the direction of the axis line O which is applied to the tool body 1 is propagated to the cutting edge portion 7 of the rotary excavation tip 5A. However, as in the attachment means of the thirteenth to sixteenth examples illustrated in FIGS. 11A to 12B, a buffer material 12 may be interposed between a rear end surface 6E of the embedding portion 6 of the rotary excavation tip 5A and a hole bottom surface 8G of the embedding hole 8.

Figure 11A:
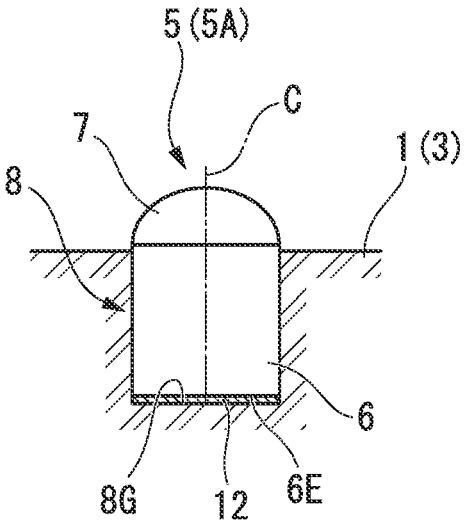
FIG. 11A is a cross-sectional view taken along the central axis, which illustrates a thirteenth example of the rotary excavation tip and the embedding hole according to the embodiments illustrated in FIGS. 1 to 5B.
Figure 11B:
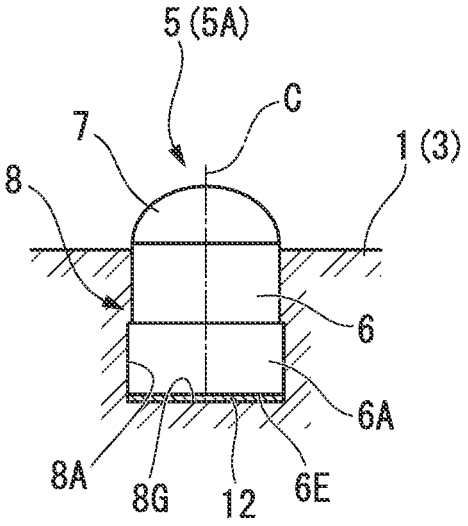
FIG. 11B is a cross-sectional view taken along the central axis, which illustrates a fourteenth example of the rotary excavation tip and the embedding hole according to the embodiments illustrated in FIGS. 1 to 5B.

Here, even in the attachment means of not only the thirteenth and fourteenth examples illustrated in FIGS. 11A and 11B but also the first to twelfth examples, the rear end surface 6E of the embedding portion 6 of the rotary excavation tip 5A and the hole bottom surface 8G of the embedding hole 8 have a planar shape perpendicular to the central axis C. In the thirteenth and fourteenth examples, the buffer material 12 has a disk shape which can be fitted into the hole bottom surface 8G. In addition, the buffer material 12 is formed from a copper plate, for example, which is softer than not only the rotary excavation tip 5A formed of ultra-hard alloys but also the steel configuring the tool body 1 having the embedding hole 8.

In the attachment means of the thirteenth and fourteenth examples as described above, it is possible to avoid a case where a load acting as reaction force of the striking force or the thrust force which is propagated from the tool body 1 to the rotary excavation tip 5A during the excavation so as to crush the ground or the rock can directly act on the tool body 1 from the rotary excavation tip 5A to the rear end side in the direction of the central axis C. Therefore, it is possible to further extend the tool life by preventing the above-described load from causing damage to the tool body 1. The thirteenth example illustrated in FIG. 11A is configured to interpose the buffer material 12 in the attachment means of the eleventh example illustrated in FIG. 10A. The fourteenth example illustrated in FIG. 11B is configured to interpose the buffer material 12 in the attachment means of the twelfth example illustrated in FIG. 10B.

Figure 12A:
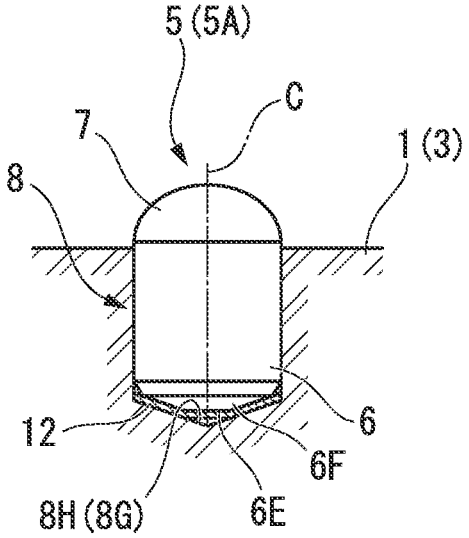
FIG. 12A is a cross-sectional view taken along the central axis, which illustrates a fifteenth example of the rotary excavation tip and the embedding hole according to the embodiments illustrated in FIGS. 1 to 5B.
Figure 12B:
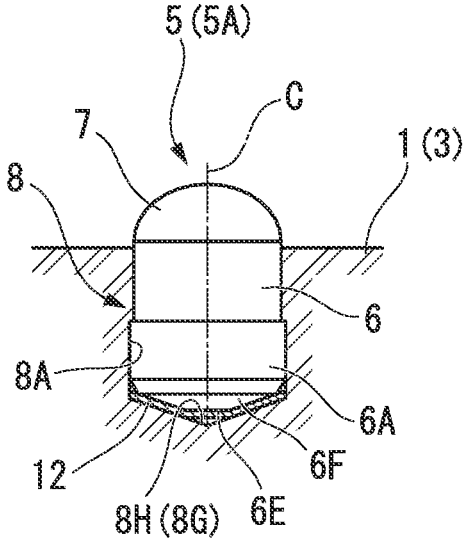
FIG. 12B is a cross-sectional view taken along the central axis, which illustrates a sixteenth example of the rotary excavation tip and the embedding hole according to the embodiments illustrated in FIGS. 1 to 5B.

In addition, in the first to fourteenth examples, as described above, the rear end surface 6E of the embedding portion 6 of the rotary excavation tip 5A and the hole bottom surface 8G of the embedding hole 8 have a planar shape perpendicular to the central axis C. However, as in the fifteenth and sixteenth examples illustrated in FIGS. 12A and 12B, a convex and conical surface-shaped portion 6F centered on the central axis C may be formed on the rear end surface 6E of the embedding portion 6, and a concave and conical surface-shaped portion 8H opposing the convex and conical surface-shaped portion 6F may be formed on the hole bottom surface 8G of the embedding hole 8. The fifteenth example illustrated in FIG. 12A is configured so that the convex and conical surface-shaped portion 6F is formed on the rear end surface 6E, the concave and conical surface-shaped portion 8H is formed on the hole bottom surface 8G, and the buffer material 12 is interposed between the rear end surface 6E and the hole bottom surface 8G in the thirteenth example illustrated in FIG. 11A. The sixteenth example illustrated in FIG. 12B is configured so that the convex and conical surface-shaped portion 6F is formed on the rear end surface 6E, the concave and conical surface-shaped portion 8H is formed on the hole bottom surface 8G, and the buffer material 12 is interposed between the rear end surface 6E and the hole bottom surface 8G in the fourteenth example illustrated in FIG. 11B.

Here, in the fifteenth and sixteenth examples, the hole bottom surface 8G of the embedding hole 8 entirely forms the concave and conical surface-shaped portion 8H centered on the central axis C. A V-shaped crossing angle formed by the concave and conical surface-shaped portion 8H in a cross section taken along the central axis C is an obtuse angle. In addition, the rear end surface 6E of the embedding portion 6 of the rotary excavation tip 5A forms a convex and circular truncated cone shape centered on the central axis C. The portion forming the conical surface is the convex and conical surface-shaped portion 6F. The V-shaped crossing angle formed by the convex and conical surface to which the convex and conical surface-shaped portion 6F is extended in a cross section taken along the central axis C is the obtuse angle equal to the crossing angle formed by the concave and conical surface-shaped portion 8H. The buffer material 12 has a dish shape formed to have a circular truncated cone-shaped surface in a cross section with a constant thickness similar to the rear end surface 6E of the embedding portion 6. In addition, a portion is chamfered between the convex and conical surface-shaped portion 6F and the outer peripheral surface of the embedding portion 6.

In the attachment means of the fifteenth and sixteenth examples described above, if the load serving as the reaction force acts on the rotary excavation tip 5A during the excavation and the rotary excavation tip 5A is pressed against the rear end side in the direction of the central axis C, the convex and conical surface-shaped portion 6F is pressed toward the concave and conical surface-shaped portion 8H, and the rotary excavation tip 5A is rotated. Therefore, the central axis C of the embedding portion 6 can be reliably coincident with the center of the embedding hole 8 so as to enable the rotary excavation tip 5A to be rotated. Even when as in the fifteenth and sixteenth examples, the embedding portion 6 is attached to the embedding hole 8 by interference fit, it is possible to prevent the embedding hole 8 from being asymmetrically worn.

In the fifteenth and sixteenth examples, the buffer material 12 is interposed between the rear end surface 6E of the embedding portion 6 of the rotary excavation tip 5A and the hole bottom surface 8G of the embedding hole 8. However, without interposing the buffer material 12 therebetween, the convex and conical surface-shaped portion 6F may be directly brought into contact with the concave and conical surface-shaped portion 8H so as to be slidable. In addition, the above-described attachment means of the fifteenth and sixteenth examples can also be applied to the attachment means in the first to twelfth examples. Furthermore, the buffer material 12, the convex and conical surface-shaped portion 6F and the concave and conical surface-shaped portion 8H in the thirteenth to sixteenth examples can also be applied to the excavation tip 5 which is fixed to the tool body 1 so as not to be rotatable.

Furthermore, although not illustrated, a surface hardened layer may be formed at least on the surface of the rotary excavation tip 5A. This surface hardened layer may be formed in any one of the embedding portion 6 of the rotary excavation tip 5A and the cutting edge portion 7, or may be formed in both of the embedding portion 6 and the cutting edge portion 7. For example, when the rotary excavation tip 5A is formed of the ultra-hard alloys as described above, coating treatment such as DLC, PVD, CVD and the like is performed on the surface of the embedding portion 6 so as to form the surface hardened layer. In this manner, it is possible to improve the strength of the embedding portion 6 and to improve the rotating and sliding performance of the embedding portion 6 inside the embedding hole 8.

In addition, when the surface hardened layer is formed on the surface of the cutting edge portion 7 of the rotary excavation tip 5A by the coating treatment, or the surface hardened layer formed of a polycrystalline diamond is formed on the surface of the cutting edge portion 7, it is possible to further extend tool life by improving the wear resistance of the cutting edge portion 7. In particular, the above-described surface hardened layer of the cutting edge portion 7 may be formed on the surface of the excavation tip 5 fixed to the tool body 1 other than the rotary excavation tip 5A so as not to be rotatable.

On the other hand, this surface hardened layer may be formed on the surface of the tool body 1. In particular, when the surface hardened layer is formed in the vicinity of the embedding hole 8 to which the rotary excavation tip 5A of the tool body 1 is attached, it is possible to prevent the embedding hole 8 from being worn due to the rotation of the rotary excavation tip 5A during the excavation. Accordingly, it is advantageous when as in the first to third examples, the concave grooves 8A and 8B and the convex portion 8C are directly formed on the inner peripheral surface of the embedding hole 8 of the tool body 1 which comes into sliding contact with the rotary excavation tip 5A, or when as in the eleventh to sixteenth examples, the embedding portion 6 of the rotary excavation tip 5A is brought into sliding contact with the embedding hole 8 by interference fit. When the tool body 1 is formed of the steel as described above, the surface hardened layer formed on the surface thereof may be formed by high-frequency hardening, carburizing, laser hardening, nitriding treatment or the like, for example, in addition to the above-described coating treatment such as DLC, PVD, CVD and the like.

Furthermore, in order to reduce the wear of the embedding hole 8 or the wear of the embedding portion 6 of the rotary excavation tip 5A as described above and in order to smoothly rotate the rotary excavation tip 5A during the excavation, particularly in the first to tenth examples in which the embedding portion 6 and the embedding hole 8 are clearance-fitted to each other, a lubricant such as a solid lubricant may be interposed between the outer peripheral surface of the embedding portion 6 and the inner peripheral surface of the embedding hole 8.

In addition, in the above-described embodiments, the excavation tool has been described in which the shank portion 2 of the rear end side of the tool body 1 receives the striking force from the down-the-hole hammer to the distal end side in the direction of the axis line O. However, the present invention can also be applied to a so-called top hammer tool attached to a rock drill used in tunnels and mines. Furthermore, as a matter of course, the present invention can also be applied to the excavation tool in which the thrust force and the rotating force transmitted from the excavation rod causes the tool body 1 to move to the distal end side in the direction of the axis line O without receiving the above-described striking force.

Hitherto, the embodiments of the present invention have been described. However, the respective configurations and the combinations thereof in the respective embodiments indicate one example, and the configurations can be added, omitted, replaced and modified within a range not departing from the spirit of the present invention. In addition, the present invention is not limited to the embodiments, and is limited only by the appended claims.

INDUSTRIAL APPLICABILITY

As described above, according to an excavation tool of the present invention, it is possible to maintain excavation performance and excavation efficiency over a longer period by using an excavation tip, to improve tool life and to reduce excavation cost per unit depth for an excavation pit. Therefore, the present invention can be used in an industrial field.

REFERENCE SIGNS LIST

1 tool body
3 distal end portion of tool body 1
3A inner peripheral portion of distal end surface
3B outer peripheral portion of distal end surface
5 excavation tip
5A rotary excavation tip
6 embedding portion
6A, 6B, 8C, 10A, 10B, 10C convex portion
6C, 6D, 8A, 8B, 8D concave groove
6E rear end surface of embedding portion 6
6F convex and conical surface-shaped portion
7 cutting edge portion
8 embedding hole
8E, 8F pothole
8G hole bottom surface of embedding hole 8
8H concave and conical surface-shaped portion
10 intermediate member
11A C-type ring (locking member)
11B pin (locking member)
11C ball (locking member)
12 buffer material
O axis line of tool body 1
C central axis of excavation tip 5

The invention claimed is:

1. An excavation tool comprising:

a tool body centered on an axis line; and an excavation tip which is attached to an embedding hole drilled in a distal end portion of the tool body, wherein the tool body is centered on the axis line and is moved forward to a distal end side in a direction of the axis line, the excavation tip has an embedding portion, the embedding portion of the excavation tip having an outer cylindrical shape about a central axis, the embedding portion is formed integrally with a cutting edge portion of a distal end side in a direction of the central axis, the embedding portion is inserted into the embedding hole and the cutting edge portion is protruded from the embedding hole, and at least one excavation tip serves as a rotary excavation tip which is rotatable about the central axis of the embedding portion during excavation, is locked so as not to slip toward the distal end side in the direction of the central axis and is attached to the embedding hole, between an outer peripheral surface of the embedding portion of the rotary excavation tip and an inner peripheral surface of the embedding hole to which the rotary excavation tip is attached, a first surface has a concave groove going around the central axis and a second surface has a convex portion accommodated in the concave groove, and the convex portion is formed integrally with the second surface.

2. The excavation tool according to claim 1, wherein a plurality of the excavation tips is attached to the tool body, and out of the excavation tips, some of the excavation tips serve as the rotary excavation tips and the remaining excavation tips are fixed and attached to the tool body.

3. The excavation tool according to claim 1, wherein a plurality of the excavation tips is attached to the tool body, and out of the excavation tips, at least one excavation tip attached to an outer peripheral portion of a distal end surface of the tool body serves as the rotary excavation tip and the remaining excavation tips are fixed and attached to the tool body.

4. The excavation tool according to claim 3, further comprising an inner peripheral portion of the distal end surface of the tool body, and at least one of the plurality of the excavation tips being disposed in the inner peripheral portion.

5. The excavation tool according to claim 4, wherein the outer peripheral portion of the distal end surface is a tapered surface tilted toward a rear end side of the tool body.

6. The excavation tool according to claim 1, wherein the embedding portion of the rotary excavation tip is attached to the embedding hole by interference fit in which an interference of an outer diameter d (mm) of the embedding portion is in a range of 0.5×d/1000 (mm) to 1.5×d/1000 (mm).

7. The excavation tool according to claim 1, wherein a surface-hardened layer is formed on at least a surface of the rotary excavation tip.

8. The excavation tool according to claim 1, wherein a surface-hardened layer is formed in the vicinity of the embedding hole to which at least the rotary excavation tip of the tool body is attached.

9. The excavation tool according to claim 1, wherein a lubricant is interposed between the outer peripheral surface of the embedding portion of the rotary excavation tip and the inner peripheral surface of the embedding hole to which the rotary excavation tip is attached.

10. The excavation tool according to claim 1, wherein the convex portion is a rear end portion of the embedding portion of the rotary excavation tip, the rear end portion has a cylindrical shape whose radius is larger than that of a front end portion of the embedding portion.

11. The excavation tool according to claim 1, wherein the convex portion is an annular convex portion which protrudes from the outer peripheral surface of the embedding portion of the rotary excavation tip and goes around the central axis of the embedding portion.

12. The excavation tool according to claim 1, wherein the convex portion is an annular convex portion which protrudes from the inner peripheral surface of the embedding hole and goes around the central axis of the embedding hole.

* * * * *